US011959267B2

(12) United States Patent
Sternitzky et al.

(10) Patent No.: US 11,959,267 B2
(45) Date of Patent: Apr. 16, 2024

(54) FORCE ACTUATED LIQUID DISPENSER

(71) Applicant: Dennis Lee Sternitzky, Plano, TX (US)

(72) Inventors: Dennis Lee Sternitzky, Plano, TX (US); Troy Cooksey, Cincinnati, OH (US)

(73) Assignee: Dennis Lee Sternitzky, Plano, TX (US)

( * ) Notice: Subject to any disclaimer, the term of this patent is extended or adjusted under 35 U.S.C. 154(b) by 0 days.

(21) Appl. No.: 17/525,180

(22) Filed: Nov. 12, 2021

(65) Prior Publication Data

US 2022/0145606 A1 May 12, 2022

Related U.S. Application Data

(60) Provisional application No. 63/113,077, filed on Nov. 12, 2020.

(51) Int. Cl.
*E03D 9/00* (2006.01)

(52) U.S. Cl.
CPC ..... *E03D 9/005* (2013.01); *E03D 9/002* (2013.01)

(58) Field of Classification Search
CPC ..... E03D 5/04; E03D 9/002; E03D 9/005; E03D 9/032
USPC ..... 4/223
See application file for complete search history.

(56) References Cited

U.S. PATENT DOCUMENTS

| | | | | | |
|---|---|---|---|---|---|
| 548,870 | A * | 10/1895 | Hager | A47K 17/00 | 4/223 |
| 641,238 | A * | 1/1900 | Ruthven | E03D 9/005 | 4/223 |
| 865,061 | A * | 9/1907 | Rose | E03D 9/005 | 4/223 |
| 4,670,916 | A * | 6/1987 | Bloom | E03D 9/005 | 222/402.15 |
| 6,178,563 | B1 * | 1/2001 | Helfet | E03D 9/005 | 4/223 |
| 7,114,199 | B2 * | 10/2006 | Conway | E03D 9/032 | 4/231 |
| 7,676,856 | B1 * | 3/2010 | Graham, II | E03D 9/005 | 4/228.1 |
| 7,895,683 | B2 * | 3/2011 | Sawalski | E03D 9/005 | 4/223 |
| 8,603,257 | B2 * | 12/2013 | Burt | E03D 9/032 | 4/231 |

FOREIGN PATENT DOCUMENTS

| | | | | |
|---|---|---|---|---|
| BE | 1017129 | * | 3/2008 | E03D 9/005 |
| GB | 191221166 | * | 7/1913 | E03D 9/005 |

* cited by examiner

*Primary Examiner* — David P Angwin
*Assistant Examiner* — Nicholas A Ros
(74) *Attorney, Agent, or Firm* — CARR Law Firm PLLC

(57) ABSTRACT

The present invention provides for an apparatus and a method for automating the dispensing a liquid agent into a toilet.

2 Claims, 26 Drawing Sheets

FORCE ACTUATED LIQUID DISPENSER

CROSS-REFERENCE TO RELATED APPLICATION

This application claims the benefit of the filing date of U.S. provisional application No. 63/113,077, filed Nov. 12, 2020, entitled FORCE ACTUATED LIQUID DISPENSER. The disclosure of which is hereby incorporated by reference.

BACKGROUND OF THE INVENTION

Field of the Invention

The present invention relates to depositing liquid agents into toilets, more particularly, to dispensers for such liquid agents.

Background

There are a number of liquid agents for use with toilets and toilet flush water to assist with cleaning, disinfecting, or improving the experience of the user of the toilet or subsequent users of the toilet. Oftentimes, these agents are in the form of a liquid that either come in a spray bottle or a vial and require the user to manually spray or apply drops of the agent directly into the toilet bowl. Depending on their purpose, these agents must be applied into the toilet bowl or the toilet bowl water specifically either before or after the toilet is used to achieve the intended result and purpose of the agent.

Problems with use of agents for toilets stem from the user forgetting to dispense the agent into the toilet bowl or simply failing to do so due to a general lack of knowledge of the purpose of the provided agent or how to use it.

SUMMARY

The present invention provides a dispenser and method for automatically dispensing a quantity of the agent into the toilet bowl in response to a force applied to the dispenser by the user sitting on the toilet.

BRIEF DESCRIPTION OF THE DRAWINGS

For a more complete understanding of the present invention and the advantages thereof, reference is now made to the following Detailed Description taken in conjunction with the accompanying drawings, in which:

FIG. 6 shows an example of a toilet the dispenser may be used with;

DETAILED DESCRIPTION

Figure 1:
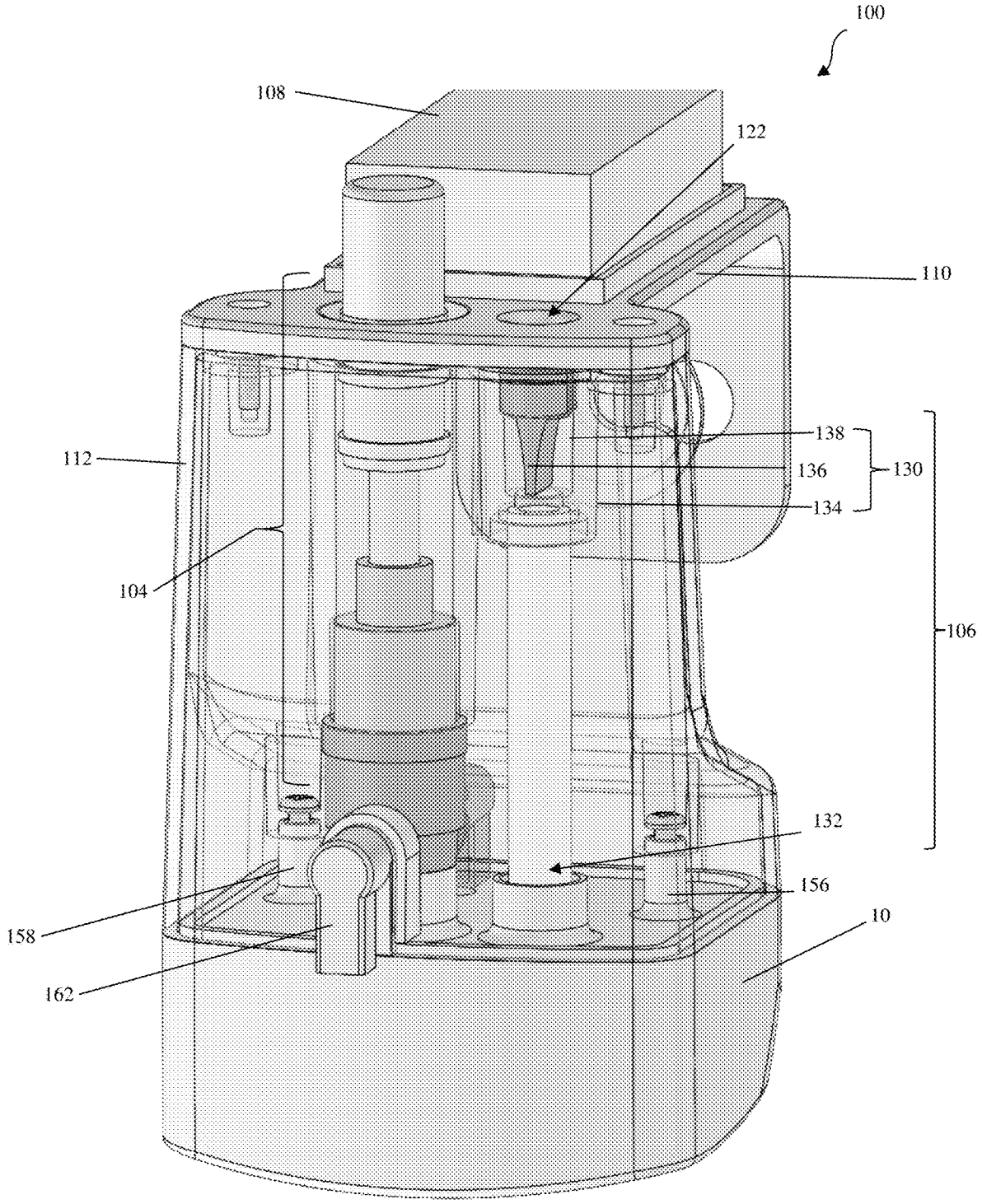
FIGS. 1-5 show a perspective view of the dispenser with the housing cover removed.
Figure 2:
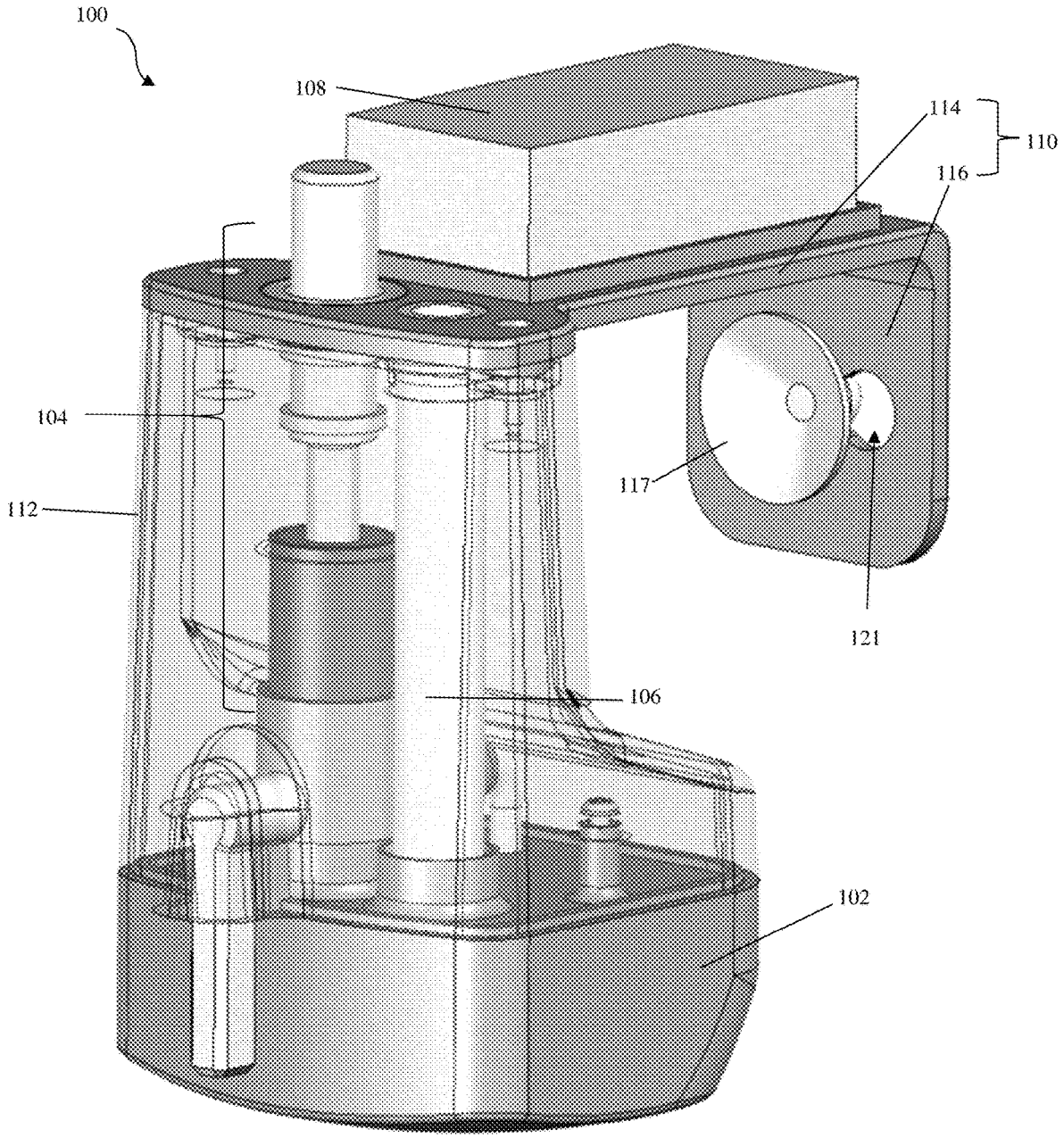
Figure 3:
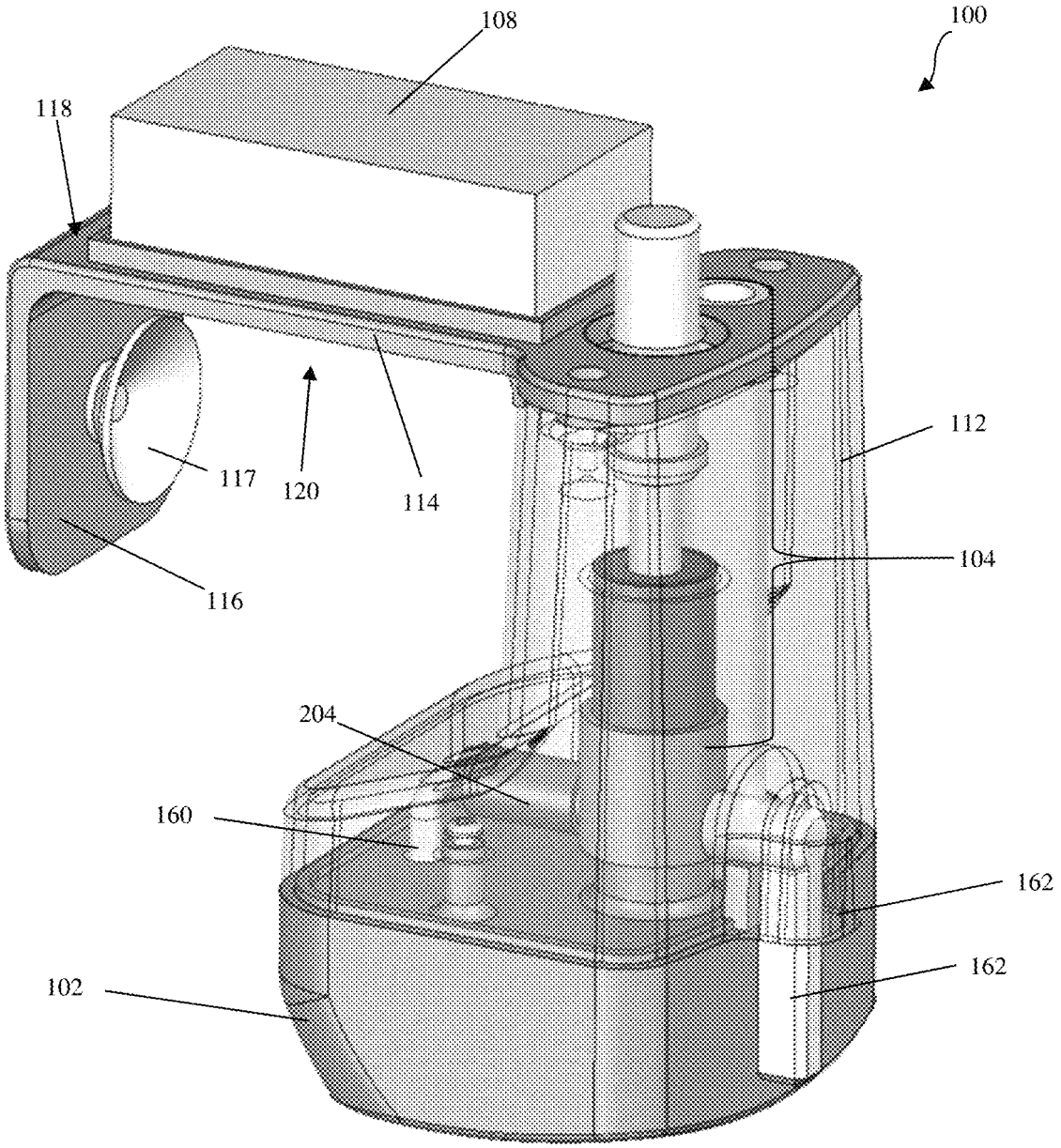
Figure 4:
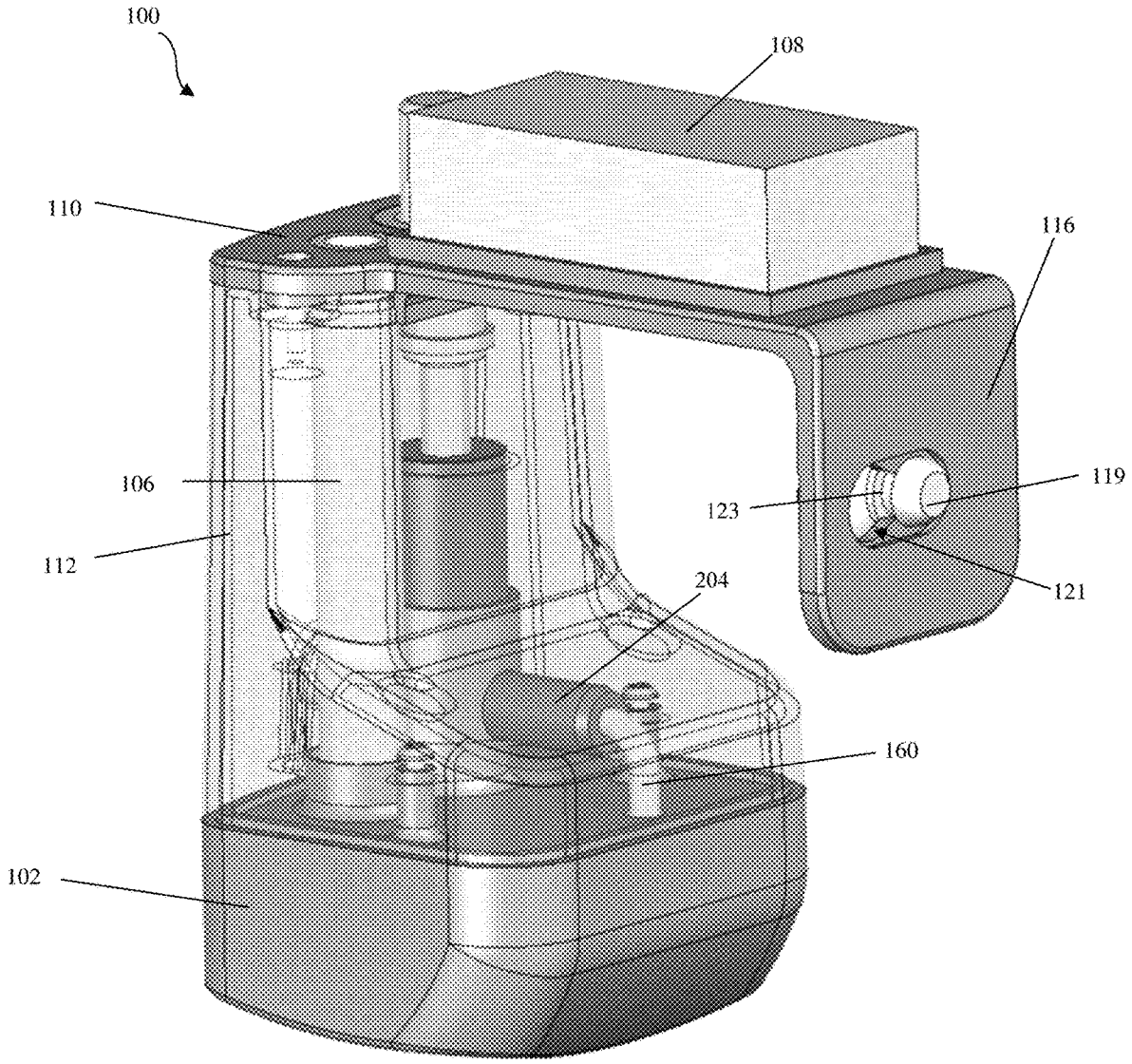

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail.

Turning now to FIGS. 1-5, an embodiment of a dispenser 100 is shown for dispensing a liquid agent into the bowl of a toilet 400. In the embodiment shown, dispenser 100 may comprise a storage reservoir 102, a pump 104, a filling tube 106, a cushion 108, a mount 110, and a housing cover 112. In dispenser 100, storage reservoir 10, pump 104, and filling tube 106 may all be enclosed within the housing cover 112.

Figure 6:
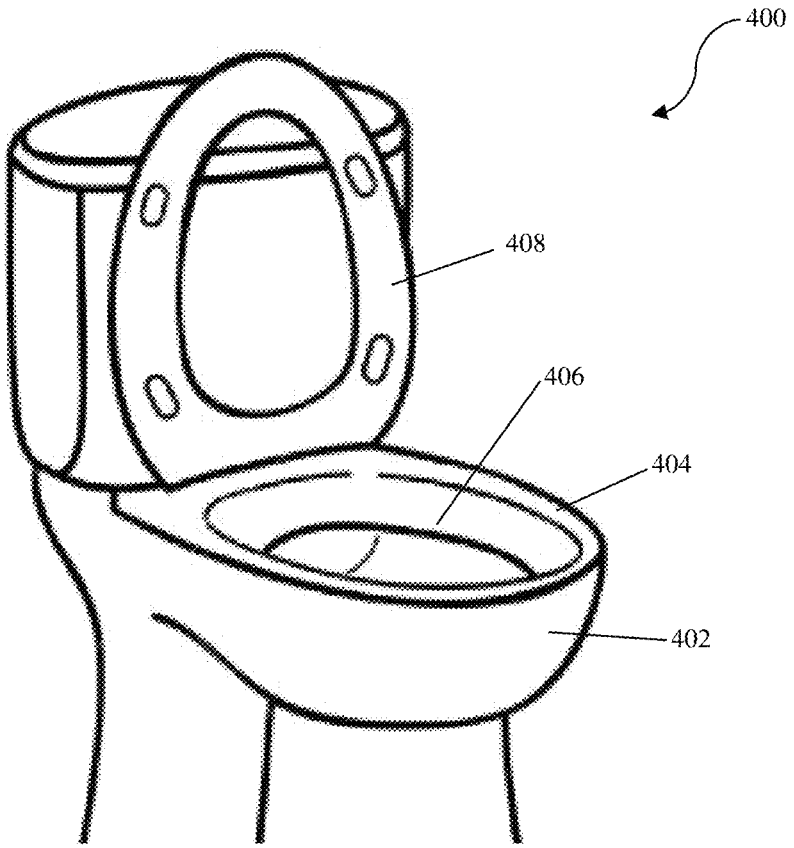
Figure 7:
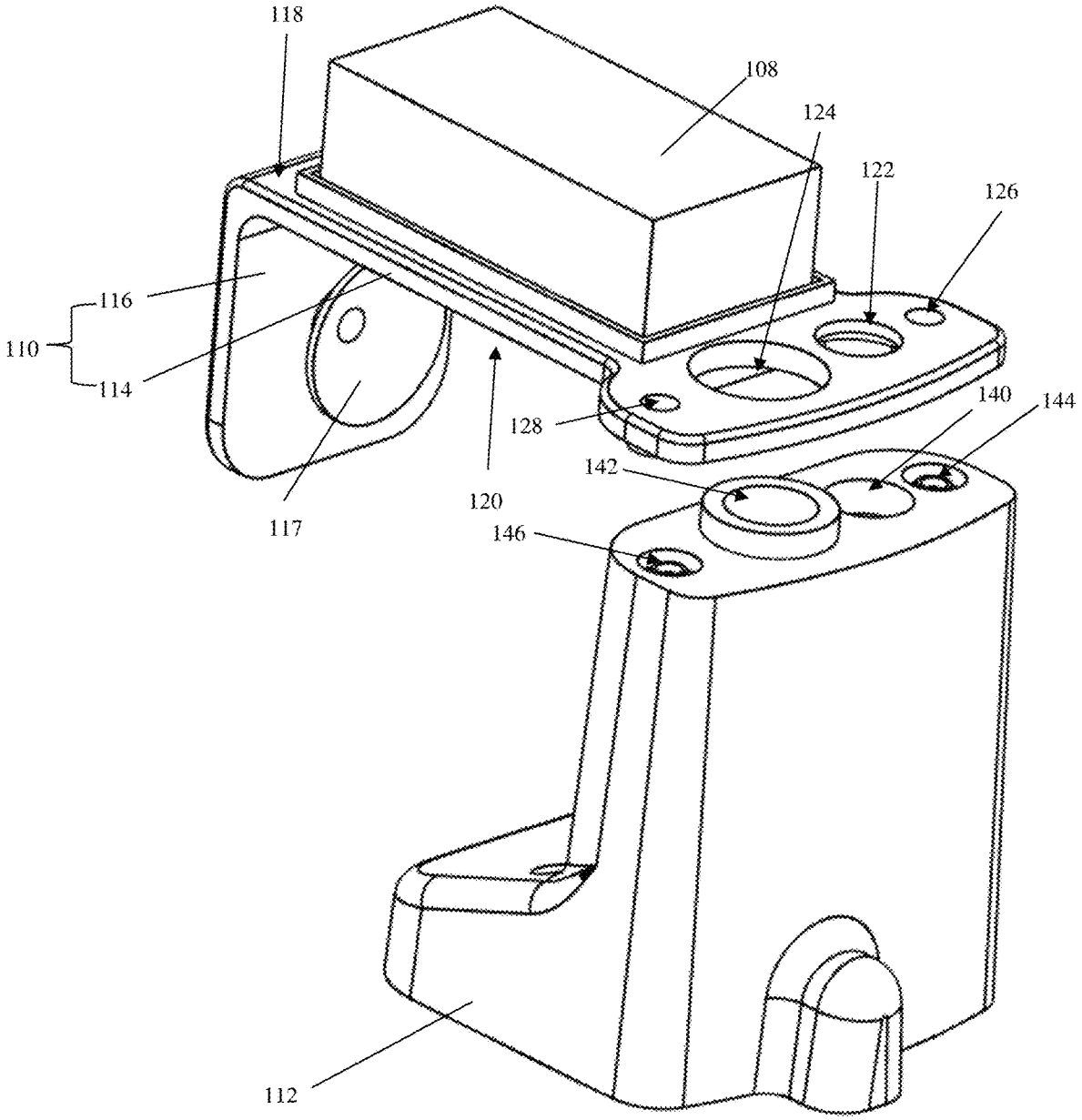
FIG. 7 shows a perspective view of the mount and housing cover.

Mount 110 may be used to secure dispenser 100 to toilet 400. An example of the toilet 400 the dispenser 100 may be used with is shown in FIG. 6. As shown in FIG. 7, in an embodiment, the mount 110 may be secured over the housing cover 112 and may extend away from the housing cover 112. Mount 110 may comprise a first member 114 extending outwards from the rear of the housing cover 112 and a second member 116 extending downwards perpendicular to the extension of the first member 114. The first and second members 114, 116 of the mount 110 may form a "C" clamp with housing cover 112. When mount 110 is used to secure dispenser 100 to the toilet 400, the mount 110 may be clamped over the edge of a toilet bowl 402 such that the first member 114 is in direct contact with a top edge 404 of the toilet bowl 402 and the wall of the toilet bowl 402 is seated between the rear of the housing cover 112 and the second member 116. The housing cover 112 may be contoured to fit a typical lipped edge 406 of the toilet bowl 402 to provide additional support and stability for mounting the dispenser 100.

When dispenser 100 is mounted on the toilet 400, the body of the dispenser 100, which may comprise the storage reservoir 102, the pump 104, the filling tube 106, and the housing cover 112 may be positioned inside the toilet bowl 402 over the flush water. The second member 116 of mount 110 may extend from the first member 114 downwards along the exterior of the toilet bowl 402. In the embodiment shown, the second member 116 may further comprise a suction cup 117 for securing the second member 116 and the dispenser 100 to the toilet 400.

The suction cup 117 may comprise an attachment member 119 extending from the convex side of the suction cup 117. The attachment member 119 may connect to the suction cup 117 at a junction 123 such that the cross-sectional thickness of the junction 123 may be smaller than the size of the suction cup 117 or the attachment member 119. The second member 116 of the mount 110 may further comprise at a third opening 121 for affixing the suction cup 117 to the dispenser 100. The third opening 121 may be sized and shaped to resemble a cutout of the perimeter of two different sized circles joined together on one edge to form a shape similar to an "infinite symbol." The diameter of the larger circular opening forming part of the third opening 121 may be slightly larger than the size of the attachment member 119 but smaller than the suction cup 117 such that the attachment member 119 may fit through larger opening and the suction cup 117 may not. The diameter of the smaller circular opening forming part of the third opening 121 may be slightly larger than the size of the junction 123 between the attachment member 119 but smaller than both the attachment member 119 and the suction cup 117. The suction cup 117 may be secured to the second member 116 by initially inserting the attachment member 119 through the larger circular opening in the third opening 121 and sliding the suction cup 117 from the larger circular opening towards the smaller circular opening along the junction 123 between the attachment member 119 and the suction cup 117. When positioned in the smaller circular opening of the third opening 121, the suction cup 117 may be affixed to the second member 116 by having portions of the second member 116 and the third opening 121 interlocked between the attachment member 119 and the suction cup 117.

Alternatively, other forms of mounts can be used to secure the second member 116 to the toilet 400, including but not limited to an adhesive strip, magnets, hook and loops strips, and the like.

Turning to FIG. 6, the first member 114 of mount 110 may comprise a top surface 118 and a bottom surface 120. When mounted over the edge of the toilet bowl 402 [this should have a reference numeral throughout], the bottom surface 120 of the first member 114 may be in direct contact with the top edge of the toilet bowl 402. Cushion 108 may be positioned on top of mount 110 and extending upwards from the top surface 118 of the first member 114. In an embodiment, the cushion 108 may be made of an elastic, compressible material that tends to retain its original shape when compression forces are released, such as but not limited to high density foam, latex foam, polyurethane foam, Styrofoam, wool, and the like.

Top surface 118 of mount 110 may further comprise a first opening 122, a second opening 124, a first bore hole 126, and a second bore hole 128. First opening 122 may be positioned to open into the filling tube 106, and second opening 124 may receive a portion of the pump 104. Filling tube 106 may extend between the first opening 122 in mount 110 and the storage reservoir 102.

As shown in FIG. 1, in an embodiment, filling tube 106 may comprise a first end 130 and a second end 132. The first end 130 of filling tube 106 may be positioned to be aligned with the first opening 122 of mount 110, and the second end 132 of filling tube 106 may extend into the storage reservoir 102. The first end 130 of filling tube 106 may further comprise a tube collar 134, a filling valve 136, and a valve enclosure 138. First opening 122 may open directly into the filling valve 136. Under the first opening 122, the filling valve 136 may be encapsulated within the valve enclosure 138. The filling valve 136 and valve enclosure 138 may then connect to the remaining portion of filling tube 106 leading to storage reservoir 102. The tube collar 134, valve enclosure 138, and filling valve 136 may be concentrically positioned such that the filling valve 136, the valve enclosure 138, and a portion of the remaining filling tube 106 adjacent to the valve enclosure 138 and the filling valve 136 may then altogether be enclosed within tube collar 134.

The filling valve 136 may provide for the forward flow of air or fluid from outside the dispenser 100 into the filling tube 106, while also preventing backflow out of the filling tube 106. In the embodiment shown, the filling valve 136 may be in the form of a "duckbill valve" comprising a rounded opening on one end and two converging flaps on the other end. The converging flaps may come together to form a tapered peak usually shaped like the beak of a duck. The duckbill end of the filling valve 136 may further comprise a slit along the edge of the peak and the filling valve 136 may be manufactured from rubber, silicone, or other synthetic elastomers. The elastomeric properties of the filling valve 136 may allow the slit at the duckbill end of the valve 136 to open in response to the passage of pressurized air or fluid moving from the rounded opening end of the valve 136. Once the pressure is removed, the slit at the duckbill end returns to its flattened closed shape thereby preventing backflow. Alternatively, the filling valve 136 may be any other type of one-way check valve capable of preventing backflow after a liquid is deposited into the fill tube 106.

The rounded opening of the filling valve 136 may be positioned at the first end 130 of the filling tube 106 to control the depositing and flow of a liquid agent from the first end 130 of the filling tube 106 to the second end 132 in the storage reservoir 102. The filling valve 136 may also provide for a seal within the filling tube 106 when the filling valve 136 is closed. When the filling valve 136 is closed, a seal may be maintained within the valve enclosure 138 and/or the remaining space within filling tube 106 between the filling valve 106 and the storage reservoir 102. The filling valve 136 may also operate to prevent liquids within the storage reservoir 102 from backflowing out the filling tube 106 when the dispenser 100 is operated. The filling valve 136 may also operate to prevent air or contaminants from entering the storage reservoir 102 when the filling tube 106 is not in use.

Figure 8A:
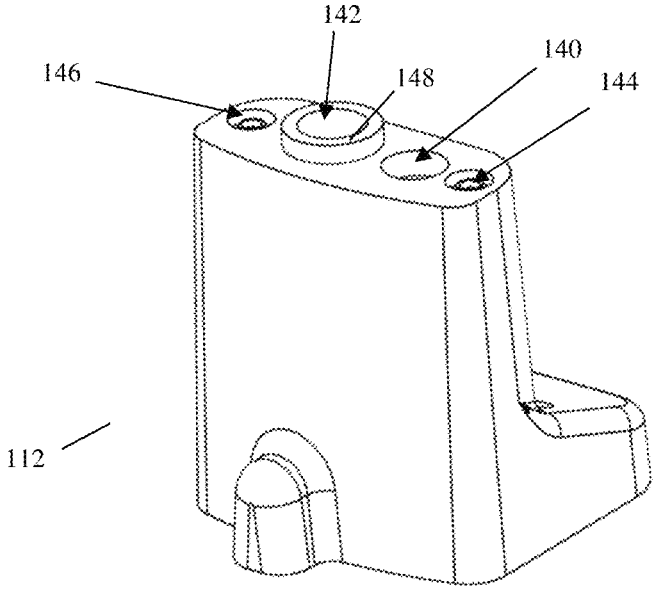
FIGS. 8A-8B show a perspective view of the housing cover.
Figure 8B:
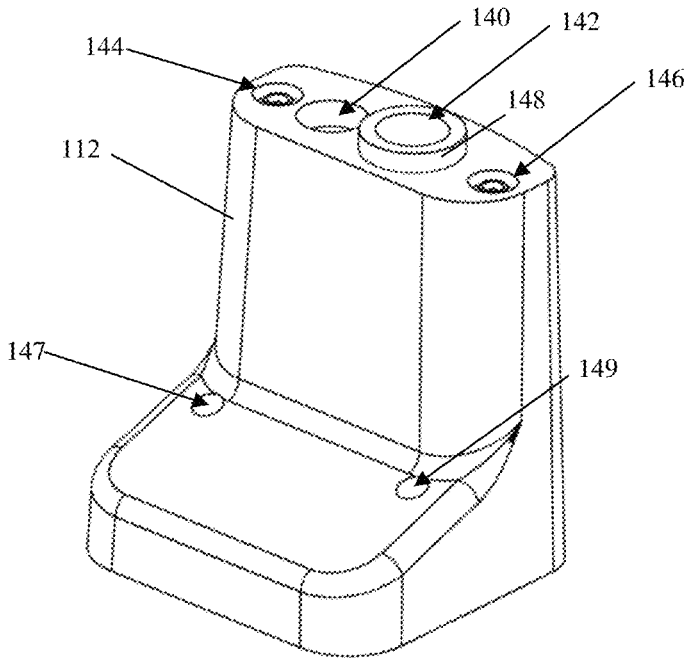

Turning to FIGS. 7 and 8, housing cover 112 may also comprise a first opening 140, a second opening 142, a first bore hole 144, a second bore hole 146, a third bore hole 147, and a fourth bore hole 149. When dispenser 100 is being assembled, in order to align mount 110 with housing cover 112, the first and second openings 122, 124 in mount 110 may be positioned over first and second openings 140, 142 in housing cover 112, respectively. Second opening 142 in housing cover 112 may further comprise an extruded flange 148 that may fit into the second opening 124 in mount 110 to prevent any shifting or lateral movement of mount 110. In order to secure mount 110 to the housing cover 112, the first and second bore holes 126, 128 in mount 110 may similarly be positioned over the first and second bore holes 140, 142 in housing cover 112. The first and second bore holes 140, 142 may be threaded to receive a screw or any other type of threaded fastener. In an embodiment, screws or any other type of threaded fastener may be threaded through the first and second bore holes 126, 128, in the mount 110 and rotated into the first and second bore holes 140, 142 in the housing cover 112, respectively, to affix the mount 110 and housing cover 112 together. Other suitable fasteners, such as rivets for example, may be used as well and/or in the alternative.

Figure 9:
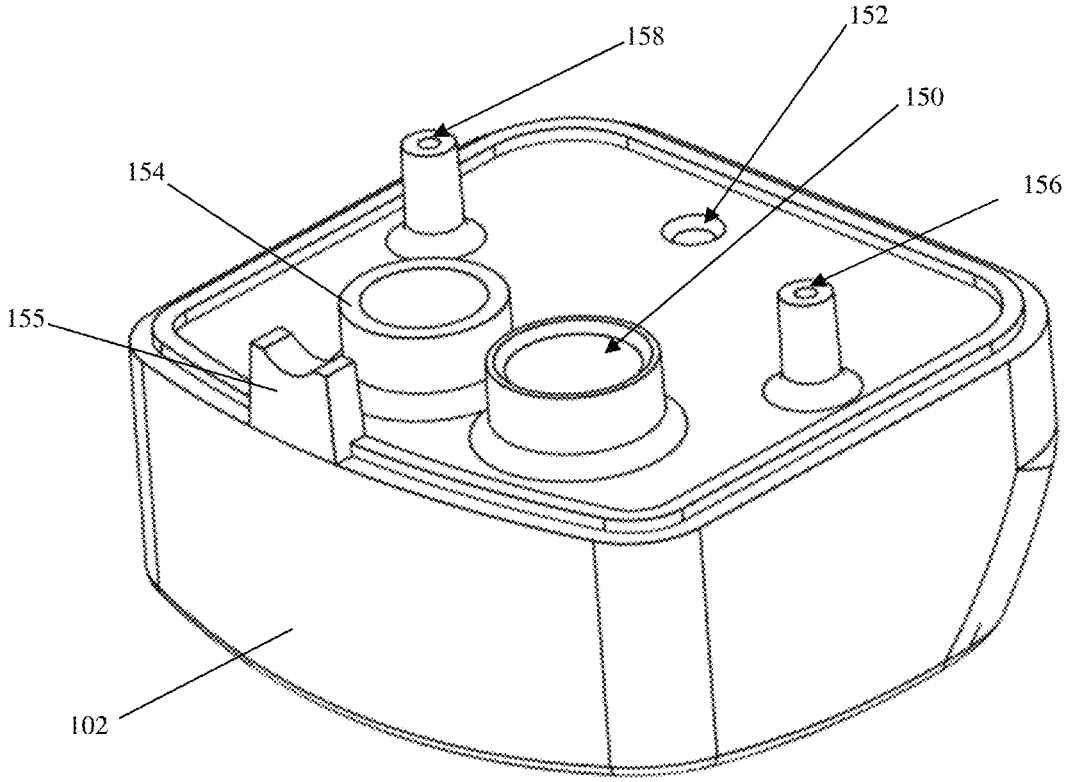
FIG. 9 shows a perspective view of the storage reservoir.
Figure 10:
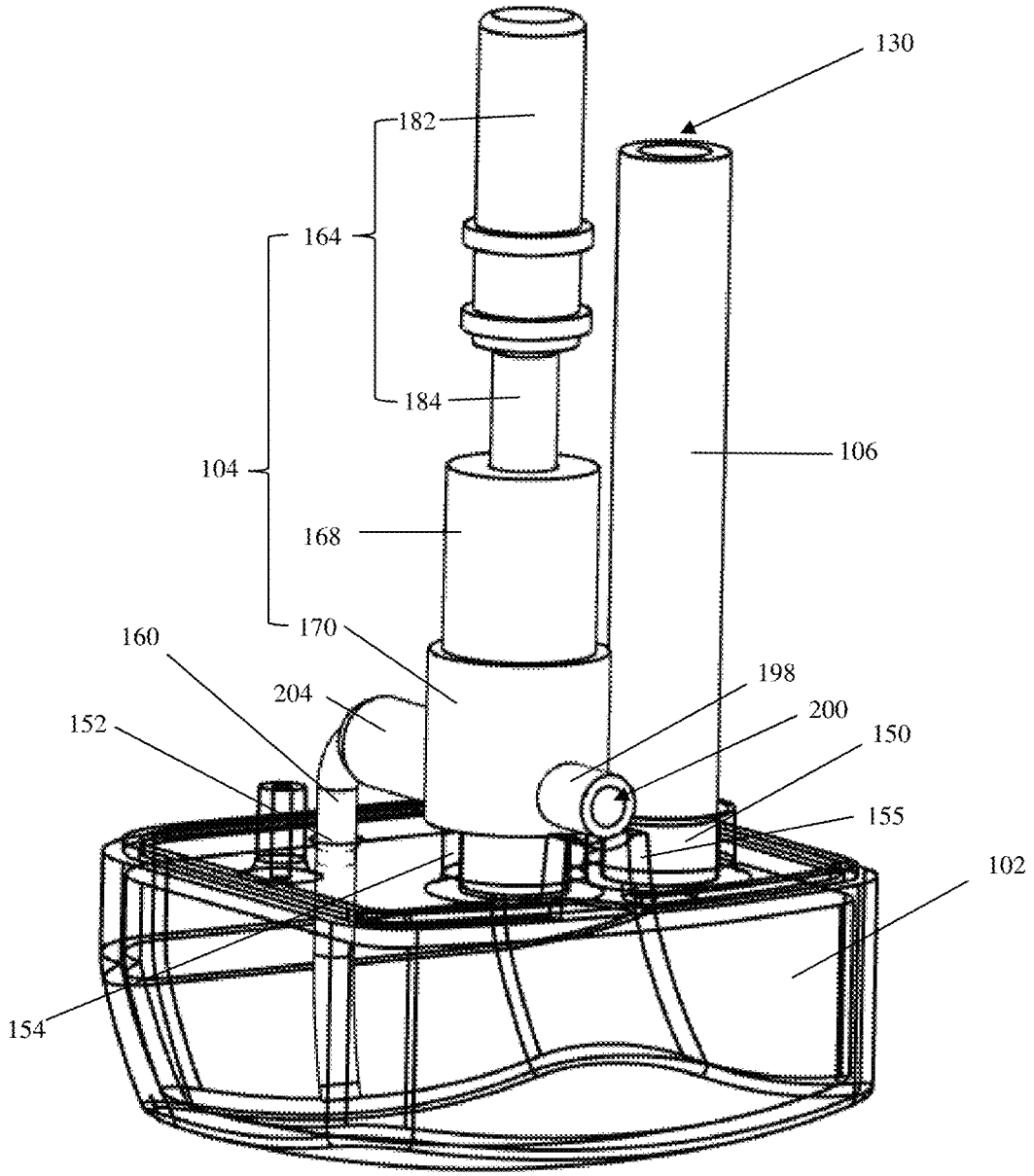
FIG. 10 shows a perspective view of the pump, the filling tube, and the storage reservoir.

Turning to FIGS. 9 and 10, the storage reservoir 102 may further comprise a first opening 150, a second opening 152, a pump slot 154, a nozzle cradle 155, a first bore hole 156, and a second bore hole 158. The filling tube 106 and pump 104 may be connected to the storage reservoir 2 through the first the second openings 150, 152, respectively. The first opening 150 may receive the second end 132 of the filling tube 106 to provide the filling tube 106 access into the storage reservoir 102. The first opening 150 may further comprise tubular extrusions extending from the surface of the storage reservoir 102 along the circumference of the first opening 150. The tubular extrusions around first opening 150 may provide additional support for the filling tube 106 when inserted into the first opening 150.

The pump slot 154 may be formed in the shape of an open cylinder with the tubular walls of the cylinder extruding from the surface of the storage reservoir 102. The pump slot 154 may be sized to match the size and shape of a base 202 of the pump 104 such that the base 202 may be fitted into the pump slot 154 and the tubular walls of the pump slot 154 may provide additional support to hold the pump 104 upright and in place.

The first and second bore holes 156, 158 may be used to affix the housing cover 112 to the storage reservoir 102. The shape of the opening at the base of the housing cover 112 may be sized to match the perimeter shape and size of the storage reservoir 102 such that the housing cover 112 may be form-fitted on to the storage reservoir 102 to enclose the interior components of the dispenser 100. The first and second bore holes 156, 158 in the storage reservoir 102 may be formed with cylindrical tubular extrusions extending from the surface of the storage reservoir 102. The interior of the tubular extrusions of the first and second bore holes 156, 158 may be threaded to allow the first and seconds bore holes 156, 158 to receive a threaded fastener, including but not limited to a threaded screw. Other suitable fasteners, such as rivets for example, may be used as well and/or in the alternative. To affix the housing cover 112 over the storage reservoir 102, the first and second openings 140, 142 in the housing cover 112 may be aligned directly on top of the first opening 150 and the pump slot 154, respectively. To secure the housing cover 112 to the storage reservoir 102, the third and fourth bore holes 147, 149 may be aligned over the first and second bore holes 156, 158 in the storage reservoir 102. Threaded fasteners may be inserted from the third and fourth bore holes 147, 149 of the housing cover 112 and rotated into the first and second bore holes 156, 158 of the storage reservoir 102 to affix the housing cover 112 to the storage reservoir 102.

When the dispenser 100 is assembled, the base 202 of the pump 104 may be seated in the pump slot 154 to mount the pump 104 on the storage take 102. An intake tube 160 may then be inserted into the second opening 152 of storage reservoir 102 to connect the pump 104 to the storage reservoir 102. Alternatively, the storage reservoir 102 may be positioned at a different location within the dispenser 100 or in a different location within the toilet bowl 402 or on the toilet 400. The storage reservoir 102 may be mounted separately from the pump 104 at a different location within the toilet bowl 402, on the top edge 404 of the toilet bowl, or along the exterior of the toilet 400, while continuing to still be connected to the pump 104 through the intake tube 160.

Figure 11:
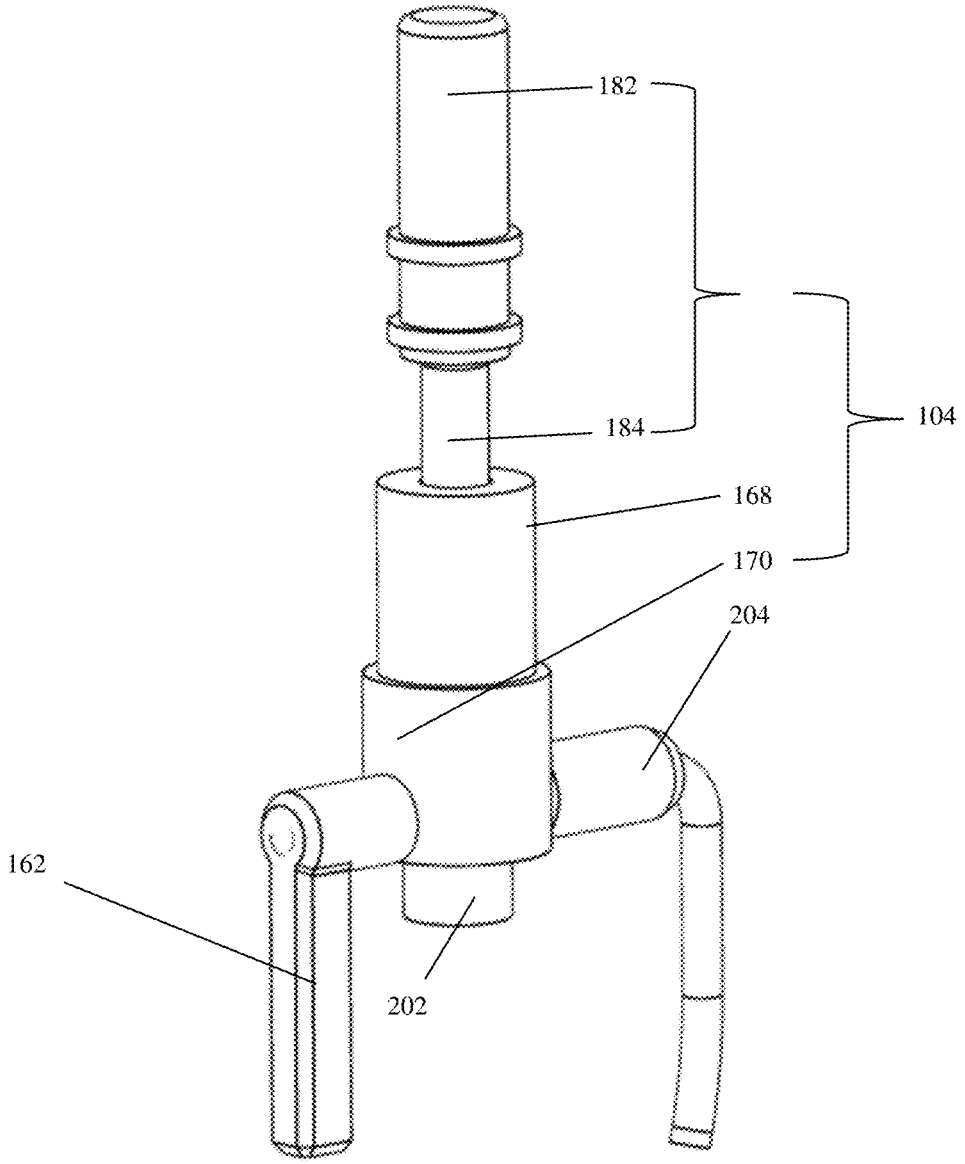
FIG. 11 shows a perspective view of the pump.
Figure 12:
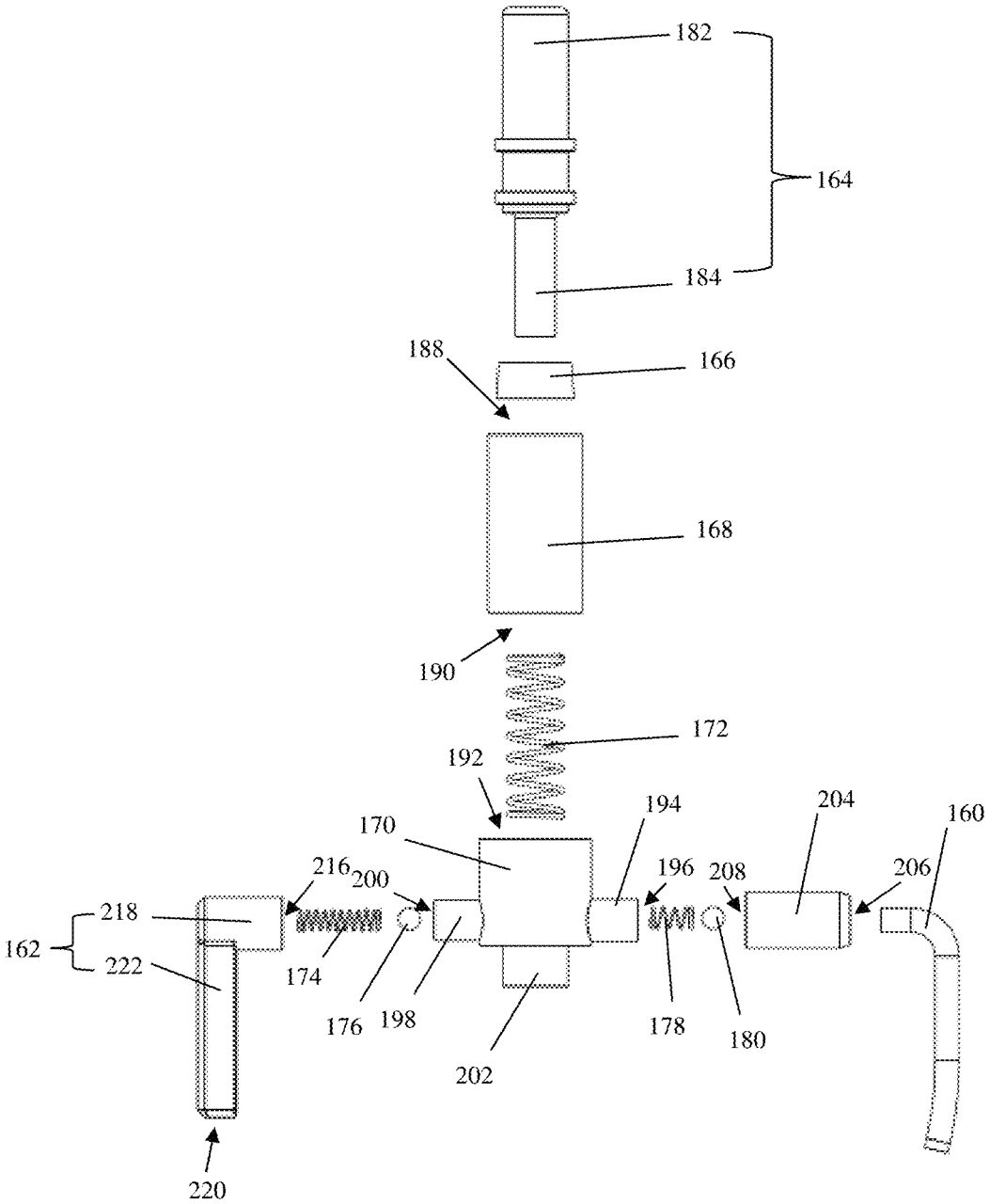
FIG. 12 shows an exploded view of the parts of the pump

Turning to FIGS. 11-12, the pump 104 may comprise a plunger 164, a piston 166, a top cylinder 168, a bottom cylinder 170, a plunger spring 172, a nozzle spring 174, a nozzle plug 176, an intake spring 178, and an intake plug 180.

The plunger 164 may further comprise a plunger handle 182 and a plunger neck 184. The top cylinder 168 may further comprise a first opening 188 and a second opening 190. The plunger 164 may be slidably connected to the top cylinder 168 and the piston 166 by inserting the plunger neck 184 through the first opening 188 in the top cylinder 168 and affixing the piston 166 to the end of the plunger neck 184 from inside the top cylinder 168. The first opening 188 may be sized to be slightly larger than the diameter of the plunger neck 184. The piston 166 may be sized to be greater than the size of the first opening 188. The plunger 164 may be slidably connected to the piston 166 inside the top cylinder 168 such that the plunger neck 184 may slide through the first opening 188 with the plunger handle 182 positioned on one side of the first opening 188 outside of the top cylinder 168 and the piston 166 positioned on the opposite side of the first opening 188 inside the top cylinder 168. The plunger handle 182 may be manipulated to move and slide the piston 166 along the interior of the top cylinder 168.

The plunger spring 172 may also be positioned inside the top cylinder 168 adjacent to the piston 166 inside the top cylinder 168 on the opposite side of the plunger neck 184. The plunger spring 172 may extend from the piston 166 towards the second opening 190 of the top cylinder 168 and the bottom cylinder 170.

The bottom cylinder 170 may further comprise a plunger opening 192, an intake pipe 194, an intake opening 196, a nozzle pipe 198, and a nozzle opening 200. The bottom cylinder 170 may be formed in the shape of a cylinder with the plunger opening 192 open at one end and the base 202 extruding from the bottom of the cylinder 170 on the opposite end. The base 202 may be hollowed out cylindrical extrusion formed to substantially match the size and shape of the pump slot 154 such that the base 202 may be fitted inside the pump slot 154. Alternatively, the base 202 may be a solid cylindrical extrusion extending out of the bottom of the bottom cylinder 170. The intake pipe 194 may extend out from the exterior side of the bottom cylinder 170 near the base 202 and form the intake opening 196. The nozzle pipe 198 may extend from the exterior side of the bottom cylinder 170 opposite of the intake pipe 194 along the same axis as the intake pipe 194 and form the nozzle opening 200. The shape of the bottom cylinder 170 formed by the intake and nozzle pipes 194, 198 extending from opposite sides of the reservoir 170 perpendicular to the longitudinal axis of the plunger opening 192 may resemble the shape of a "pipe tee," such that the space within the bottom cylinder 170, intake pipe 194, and nozzle pipe 198 may each be partially open to one another. The intake pipe 194 and the intake opening 196 may therefore operate as the inlet for flow of fluid into the pump 104, and the nozzle pipe 198 and nozzle opening 200 may be the outlet for the fluid pumped by the pump 104.

The intake pipe 194 extending from the bottom cylinder 170 may connect to the intake tube 160 at the intake opening 196. The nozzle pipe 198 extending from the bottom cylinder 170 may connect to a nozzle 162 at the nozzle opening 200. The top cylinder 168 may be connected to the bottom cylinder 170 by fitting the second opening 190 of the top cylinder 168 into the plunger opening 192 of bottom cylinder 170. When the top cylinder 168 is connected with the bottom cylinder 170, the plunger spring 172 may extend and press against the piston 166 on one end and the base of the bottom cylinder 170 at the other end.

The intake pipe 194 may be connected to the intake tube 160 by an intake sleeve 204. The intake sleeve 204 may comprise a first opening 206, a second opening 208, and a bottle neck gap 210. The interior of the intake sleeve 204 may be extruded like a double sided funnel such that the amount of space in the bottle neck gap 210 may be smaller than both the sides flaring towards their respective first and second openings 206, 208. The intake tube 160 and the intake pipe 194 may be connected by inserting the intake tube 160 into the first opening 206 of the intake sleeve 204 and the intake opening 196 of the intake pipe 194 into the second opening 208 of the intake sleeve 204. When inserted into respective ends of the intake sleeve 204, the end of the intake tube 160 and the intake opening 196 may contact opposite ends of the bottle neck gap 210 along the interior of the intake sleeve 204 without contacting one another directly.

The intake spring 178 and intake plug 180 may be positioned inside the intake pipe 194. At the junction between the intake pipe 194 and the bottom cylinder 170, the intake pipe 194 may further comprise a blocking member 212 at the end of the intake pipe 194 opposite of the intake opening 196. The blocking member 212 may be sized to allow small particles and liquids to flow from the intake pipe 194 into the bottom cylinder 170 but block larger objects such as the intake spring 178 and the intake plug 180 from extending into the bottom cylinder 170. The intake spring 178 may be positioned inside the intake pipe 194 between the blocking member 212 and the intake plug 180.

When the intake tube 160 containing the intake spring 178 and intake plug 180 are inserted into the intake sleeve 204, the intake spring 178 may be positioned between the blocking member 212 and the intake plug 180, and the intake plug 180 may be positioned between the intake spring 178 and the bottle neck gap 210. The intake plug 180 may be sized to be larger than the opening in the bottle neck gap 210 but smaller than the interior of the intake pipe 194 such that the intake plug 180 may move freely within the intake pipe 194.

The intake spring 178 may extend and apply a force against the intake plug 180 which in turn may push the intake plug 180 against the bottle neck gap 210 of the intake sleeve 204. The variable force between the intake plug 180 and the bottle neck gap 210 due to operation of the pump 104 and the varying compression and extension of the intake spring 178 may form a one way check intake valve 214 at the bottle neck gap 210 between the intake pipe 194 and the intake tube 160. The intake valve 214 may open when the intake plug 180 compresses the intake spring 178 thereby creating space between the bottle neck gap 210 and the intake pipe 194. When open, liquid may flow from the intake tube 160 into the bottom cylinder 170 through the intake pipe 194. The intake valve 214 may close when the intake spring 178 extends and pushes the intake plug 180 against the bottle neck gap 210 thereby blocking the opening in the bottle neck gap 210. When closed, the intake plug 180 may block any liquid from flowing from the intake tube 160 into the intake pipe 194.

The nozzle 162 may be connected to the pump 104 by affixing the nozzle 162 over the nozzle opening 200 in the nozzle pipe 198. The nozzle 162 may be formed as a "L" shaped right angle hollow conduit comprising of a first opening 216 at a first conduit 218 and a second opening 220 at a second conduit 222. The longitudinal axis of the first conduit 218 may be perpendicular to the longitudinal axis of the second conduit 222. When the first opening 216 and first conduit 218 of the nozzle 162 is aligned with the axis of the nozzle pipe 198, the second opening 220 and second conduit 222 may extend downwards away from the axis of the first conduit 218 and nozzle pipe 198. In the embodiment shown, the first conduit 218 of the nozzle 162 may be formed as a hollow cylindrical shaped tube to match the shape of the nozzle pipe 198. The nozzle 162 may be fitted on to the nozzle pipe 198 by inserting the nozzle pipe 198 into the first opening 216 of the first conduit 218. The second conduit 222 may be formed in the shape of a hollowed out rectangular prism. The hollowed out interior of the second conduit 222 may connect with the hollowed out interior of the first conduit 218. When the nozzle 162 is connected to the nozzle pipe 198, the nozzle 162 may direct the flow of a liquid from the nozzle pipe 198 through the first and second conduits 218, 222 and out the second opening 220. The nozzle 162 may dispense the liquid downwards in a direction perpendicular to the initial flow of the liquid from the nozzle pipe 198. When the dispenser 100 is mounted in the toilet 400, the nozzle 162 may dispense the liquid directly into the toilet bowl 402.

The nozzle spring 174 and nozzle plug 176 may be positioned inside the nozzle pipe 198. At the junction between the nozzle pipe 198 and the bottom cylinder 170, the end of the nozzle pipe 198 may further comprise a blocking flange 224 at the end of the nozzle pipe 198. The blocking flange 224 may extend inwards towards the interior of the nozzle pipe 198 thereby creating a smaller outlet opening 226 between nozzle pipe 198 and the bottom cylinder 170. The blocking flange 224 may be sized to allow small particles and liquids to flow between the nozzle pipe 198 and the bottom cylinder 170 but block larger objects such as the nozzle spring 174 and the nozzle plug 176 from extending from the nozzle pipe 198 into the bottom cylinder 170. The nozzle plug 176 may be positioned inside the nozzle pipe 198 between the nozzle spring 174 and the blocking flange 224.

When the nozzle pipe 198 containing the nozzle spring 174 and nozzle plug 176 are inserted into the first conduit 118 of nozzle 162, the nozzle plug 176 may be positioned between the nozzle spring 174 and the blocking flange 224. On the opposite side of the nozzle spring 174 away from the nozzle plug 176, the nozzle spring 174 may extend against the interior wall at the end of the first conduit 218 opposite from the first opening 216. The nozzle plug 176 may be sized to be larger than the outlet opening 226 formed by the blocking flange 224 but smaller than the interior of the nozzle pipe 198 such that the nozzle plug 176 may move freely within the nozzle pipe 198.

The nozzle spring 174 may extend and apply a force against the nozzle plug 176 which in turn may push the nozzle plug 176 against the blocking flange 224. The variable force between the nozzle plug 176 and the blocking flange 224 due to the varying compression and extension of the nozzle spring 174 may form a one way nozzle check valve 228 at the blocking flange 224 between the nozzle pipe 198 and the bottom cylinder 170. The nozzle valve 228 may open when the nozzle plug 176 compresses the nozzle spring 174 thereby creating space between the outlet opening 226 in the blocking flange 224 and the nozzle pipe 198. When open, liquid may flow from the bottom cylinder 170 through the nozzle pipe 198. The nozzle valve 228 may close when the nozzle spring 174 extends and pushes the nozzle plug 176 against the blocking flange 224 thereby blocking the outlet opening 226. When closed, the nozzle plug 176 may block any liquid from flowing from the bottom cylinder 170 into the nozzle pipe 198.

Figure 13:
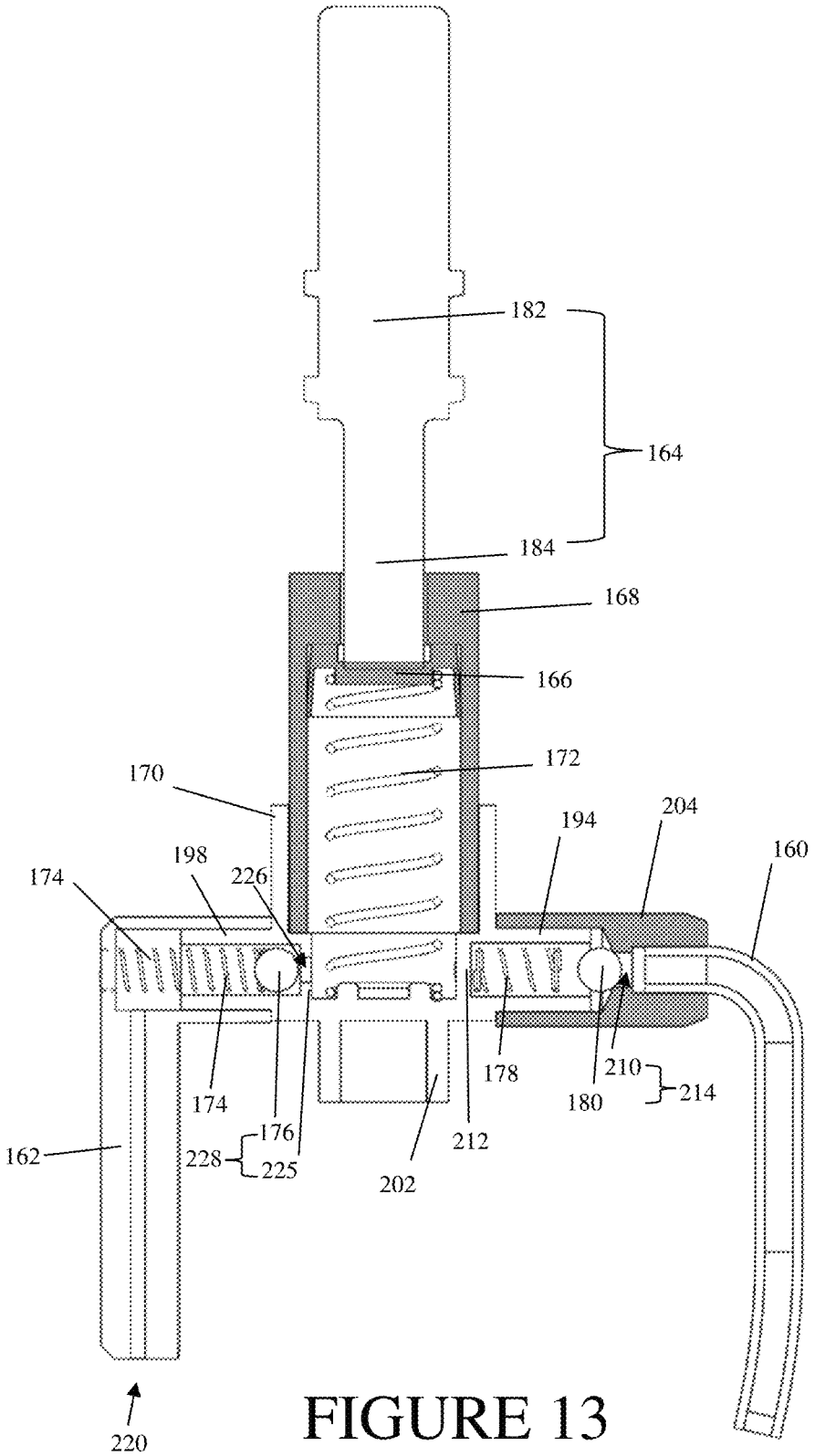
FIG. 13 shows a cross-sectional view of the pump.
Figure 14:
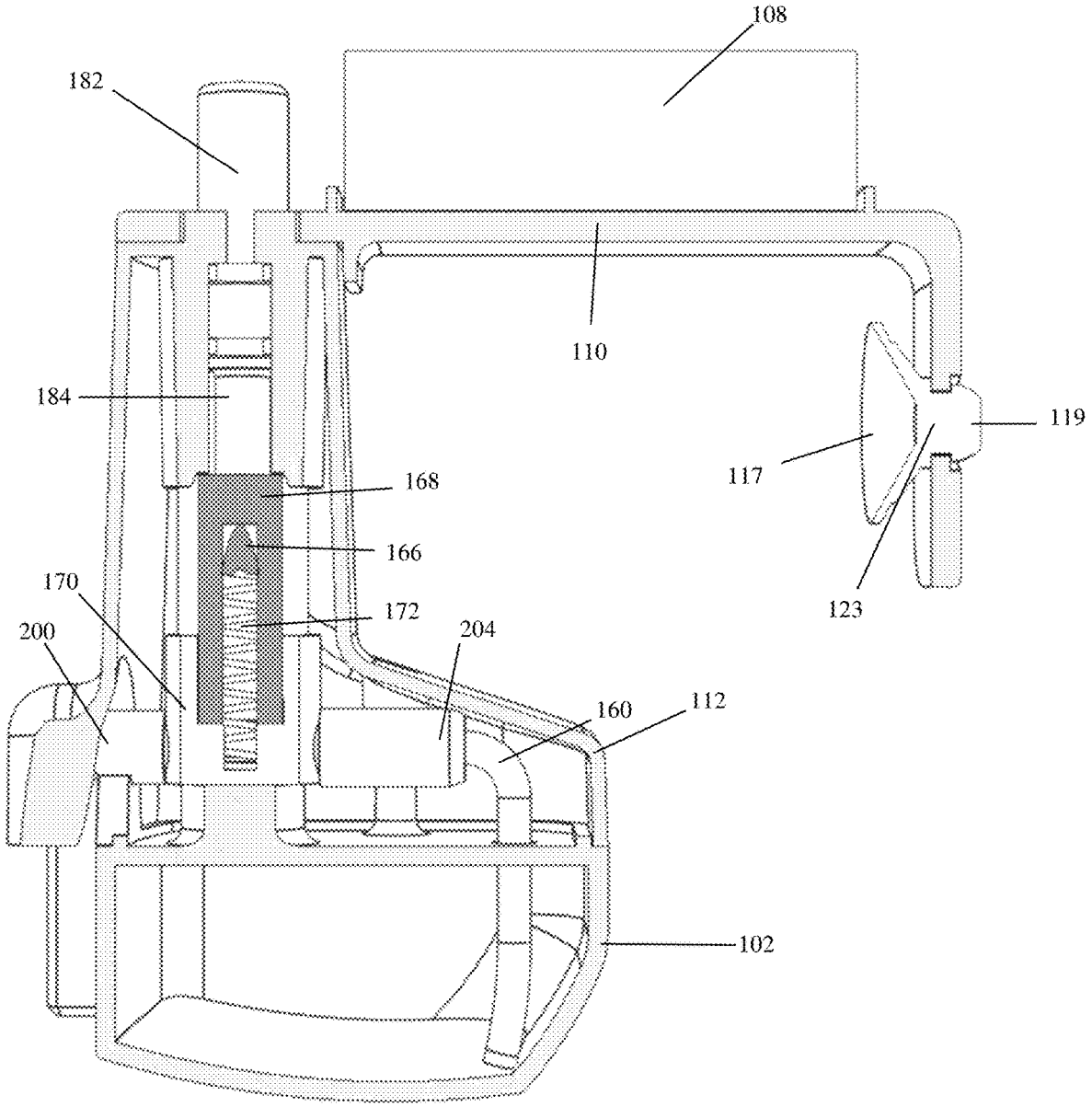
FIG. 14 shows a cross-sectional view of the dispenser.
Figure 15:
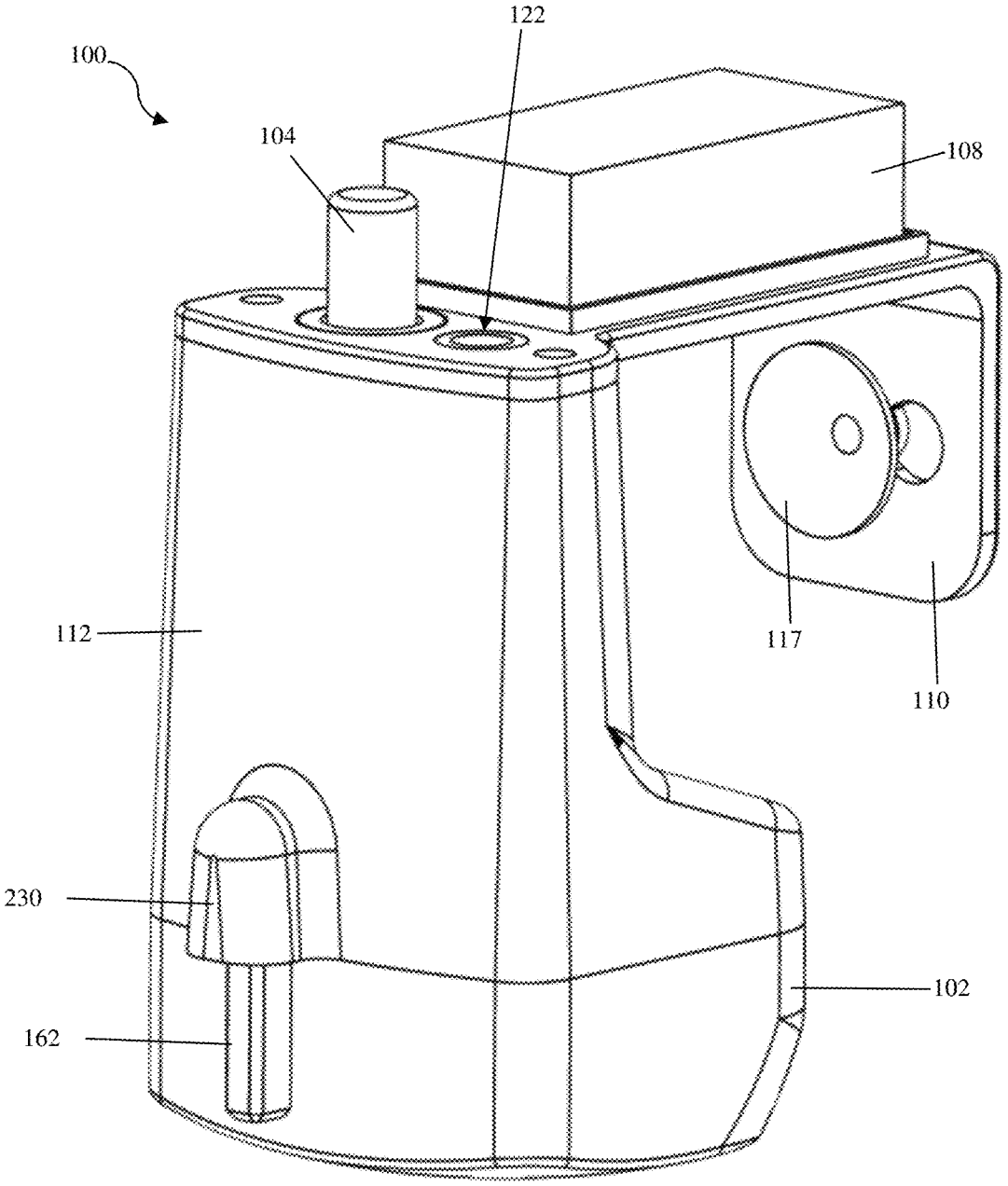
FIGS. 15-17 show a perspective view of the dispenser.
Figure 16:
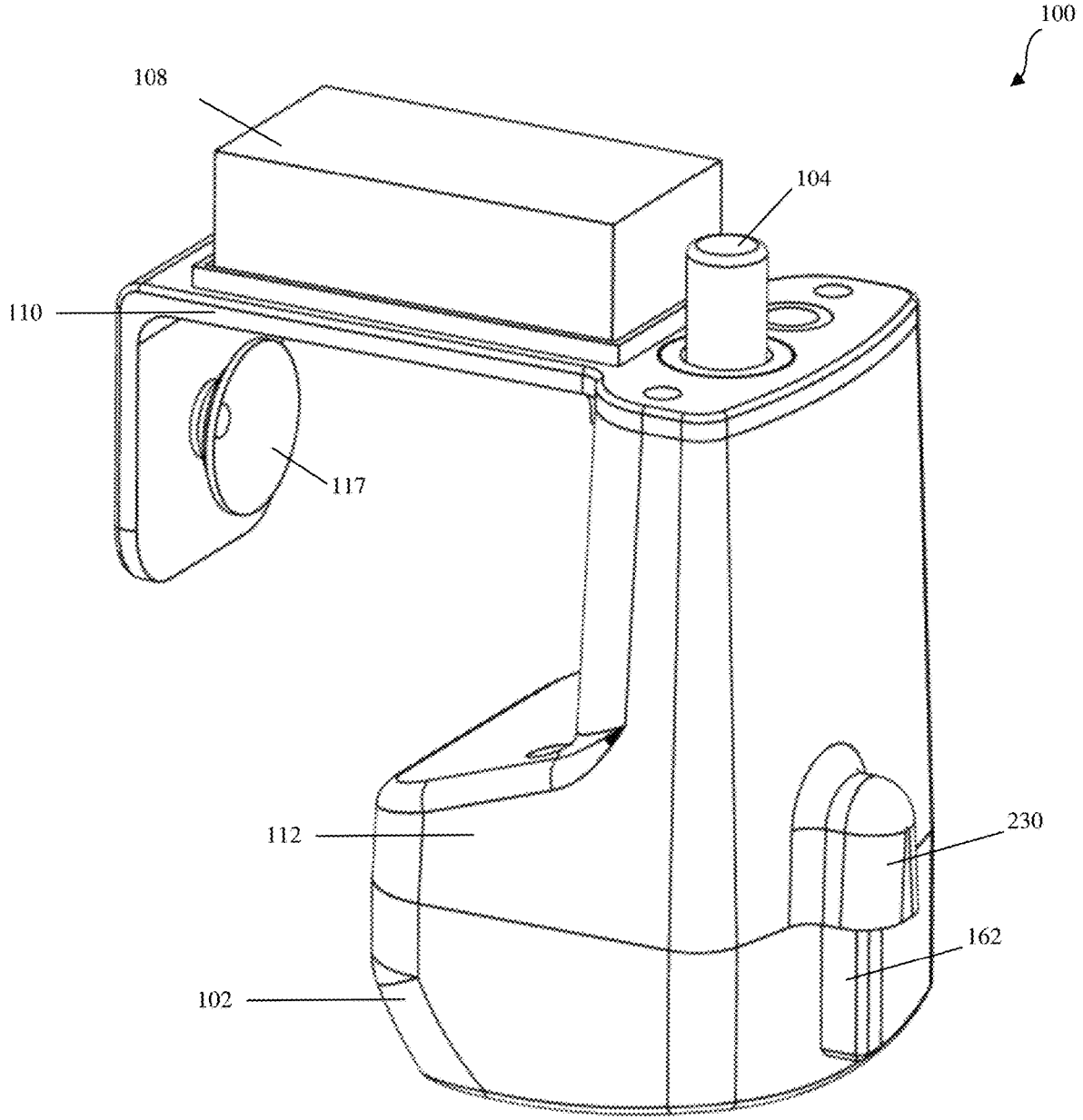
Figure 17:
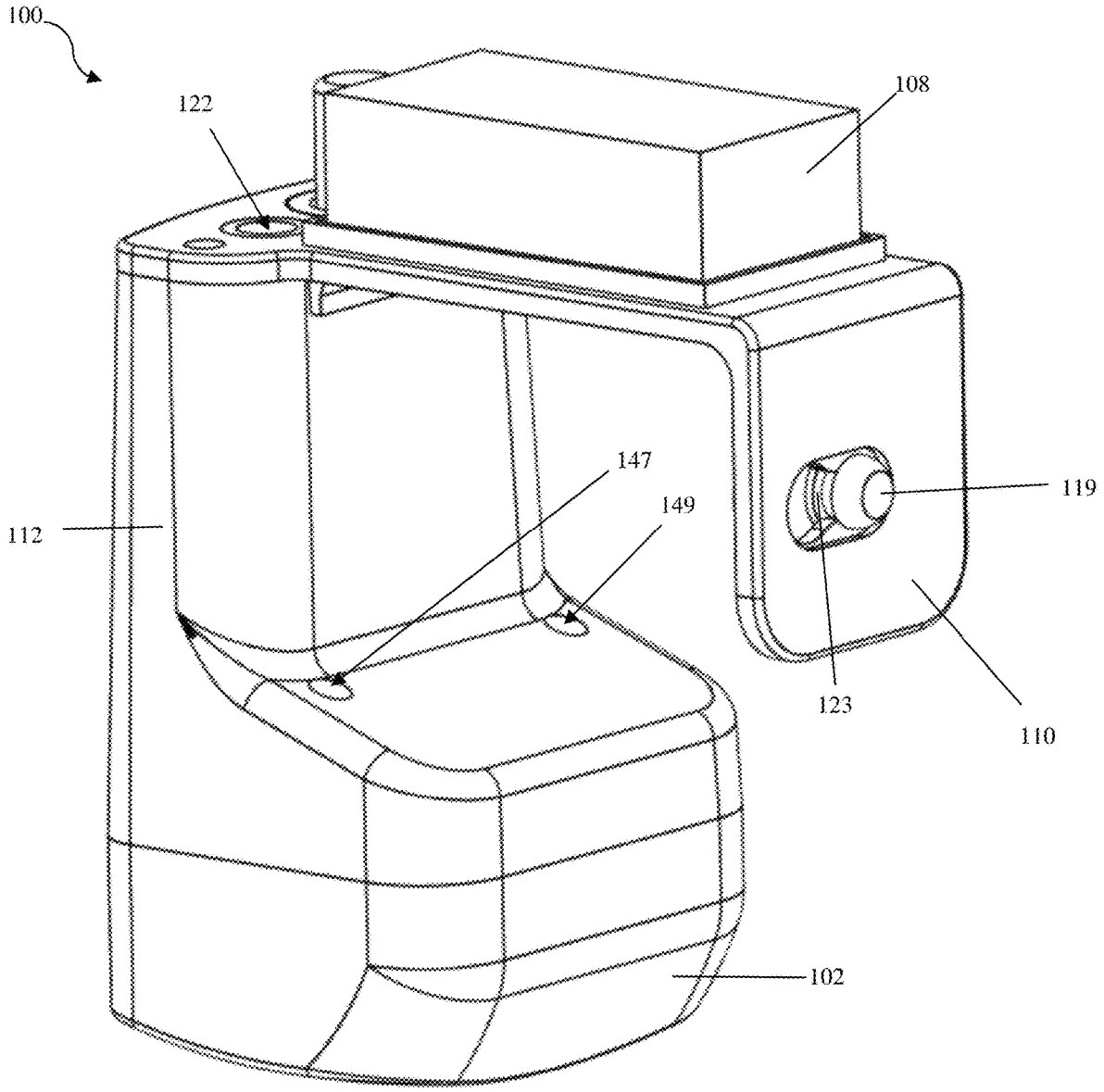
Figure 18:
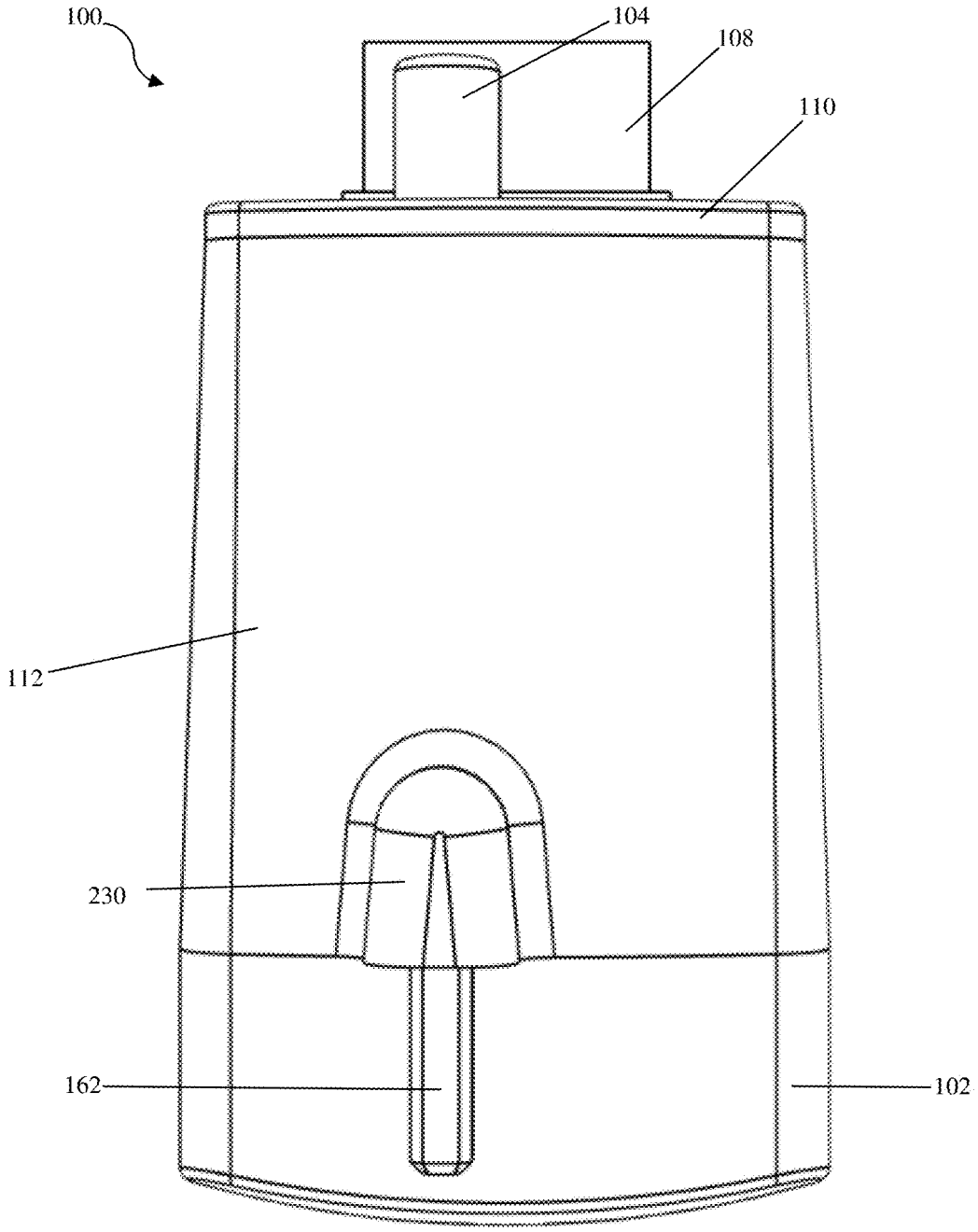
FIGS. 18 and 19 show a front and rear view of the dispenser.
Figure 19:
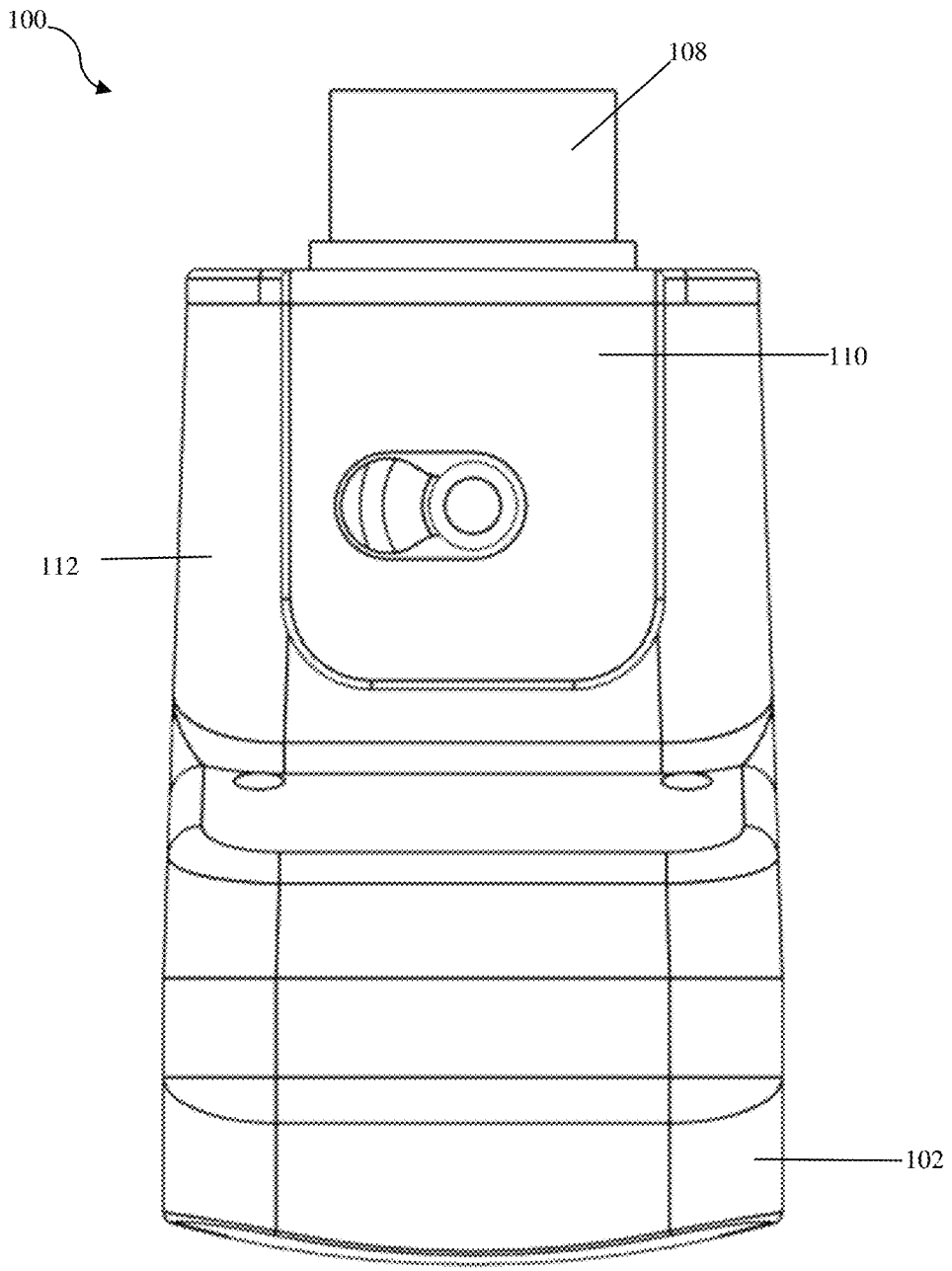
Figure 20:
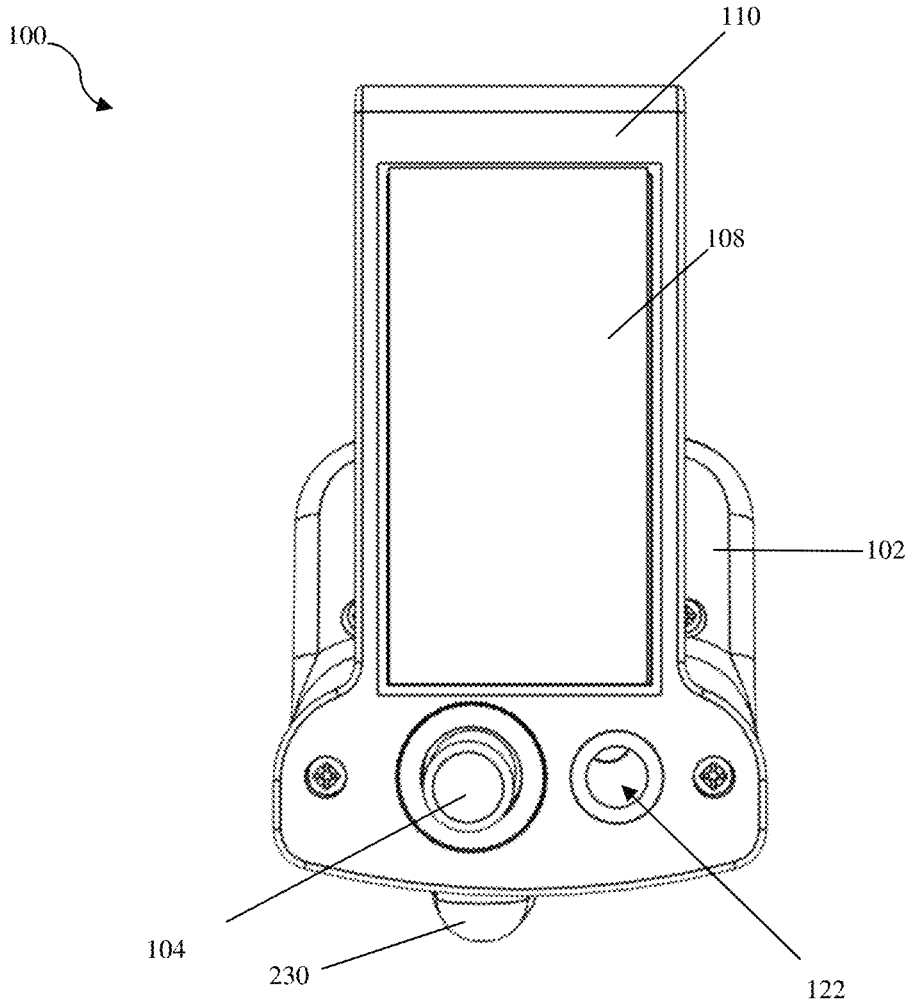
FIGS. 20 and 21 show a top and bottom view of the dispenser.
Figure 21:
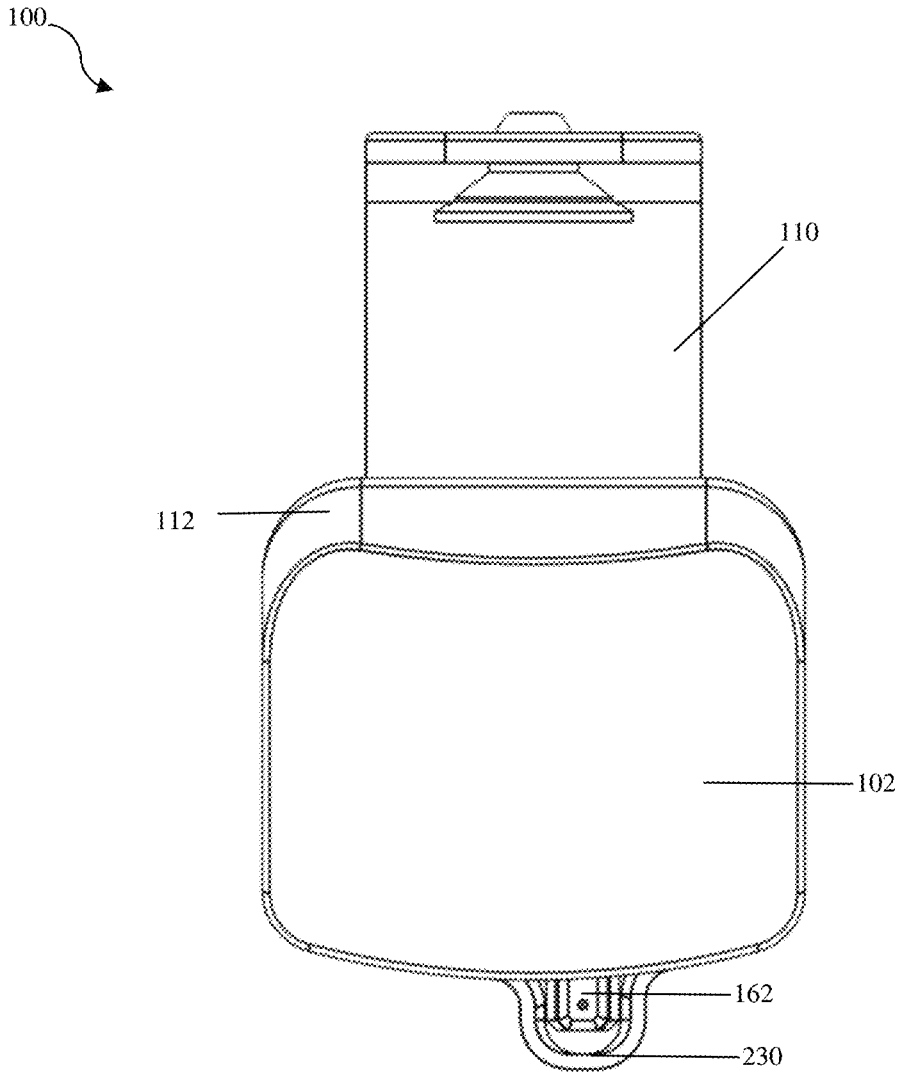
Figure 22:
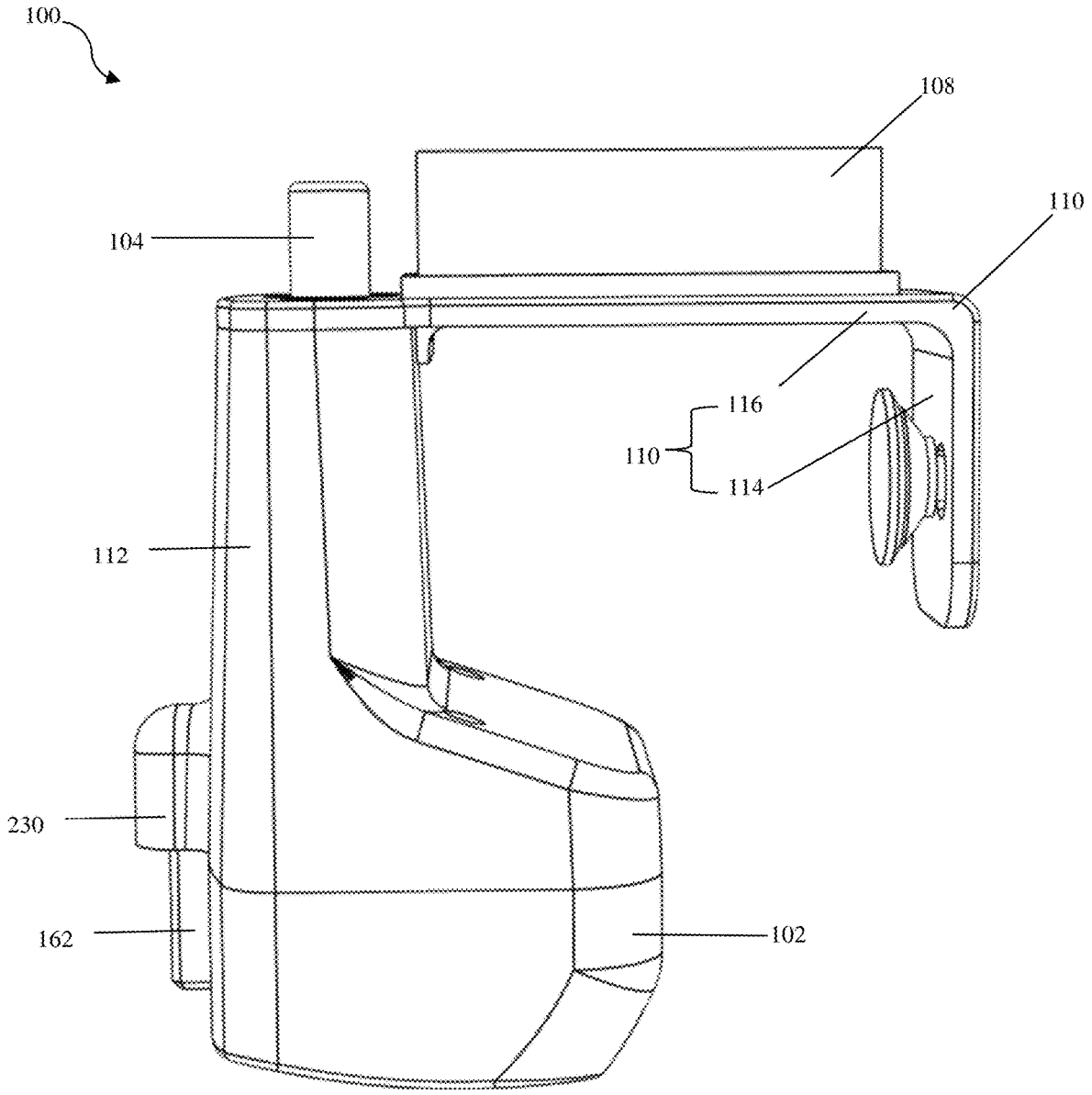
FIG. 22 shows a side view of the dispenser.
Figure 23:
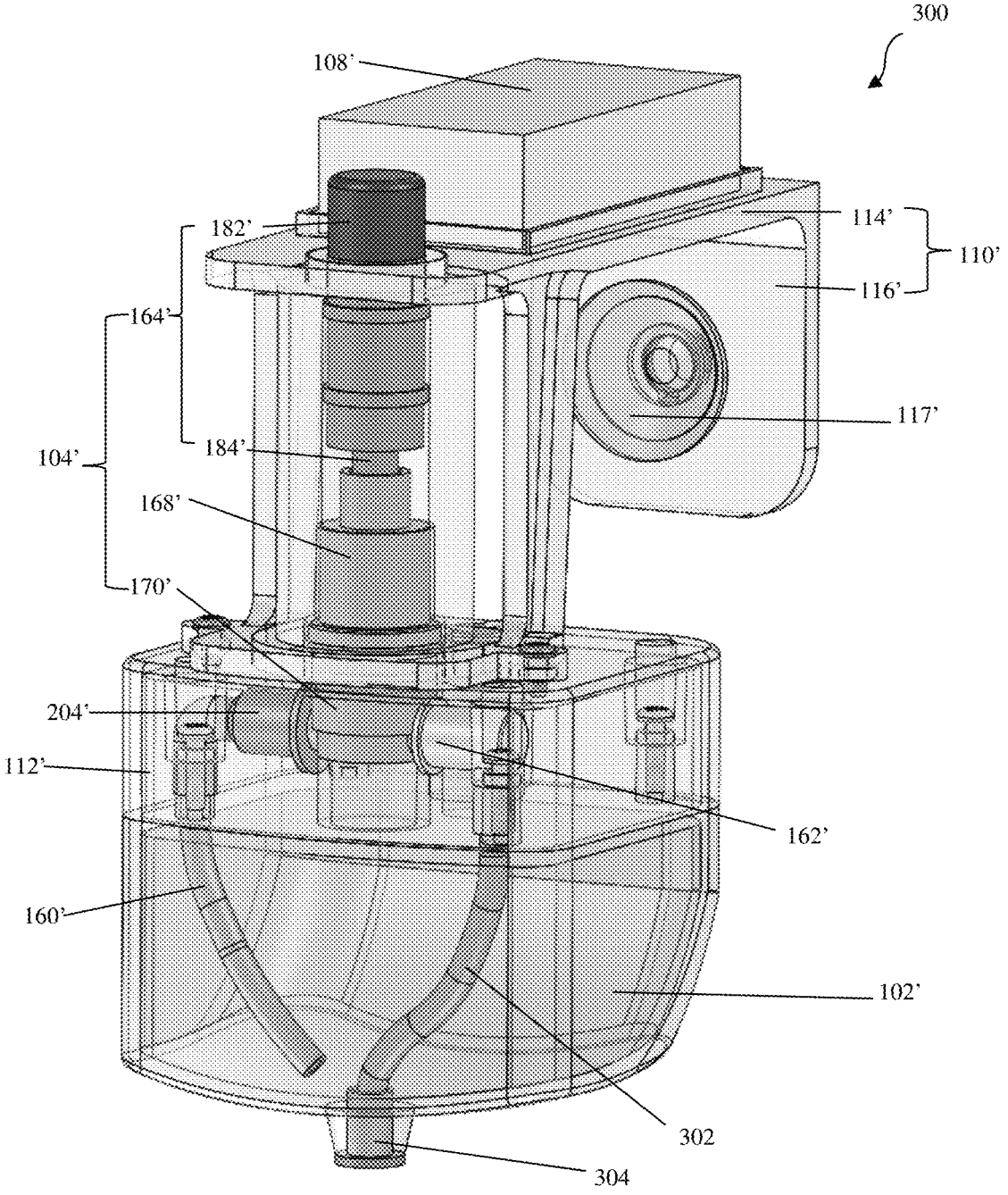
FIGS. 23-26 show cross-sectional and perspective views of a second embodiment of the dispenser.
Figure 24:
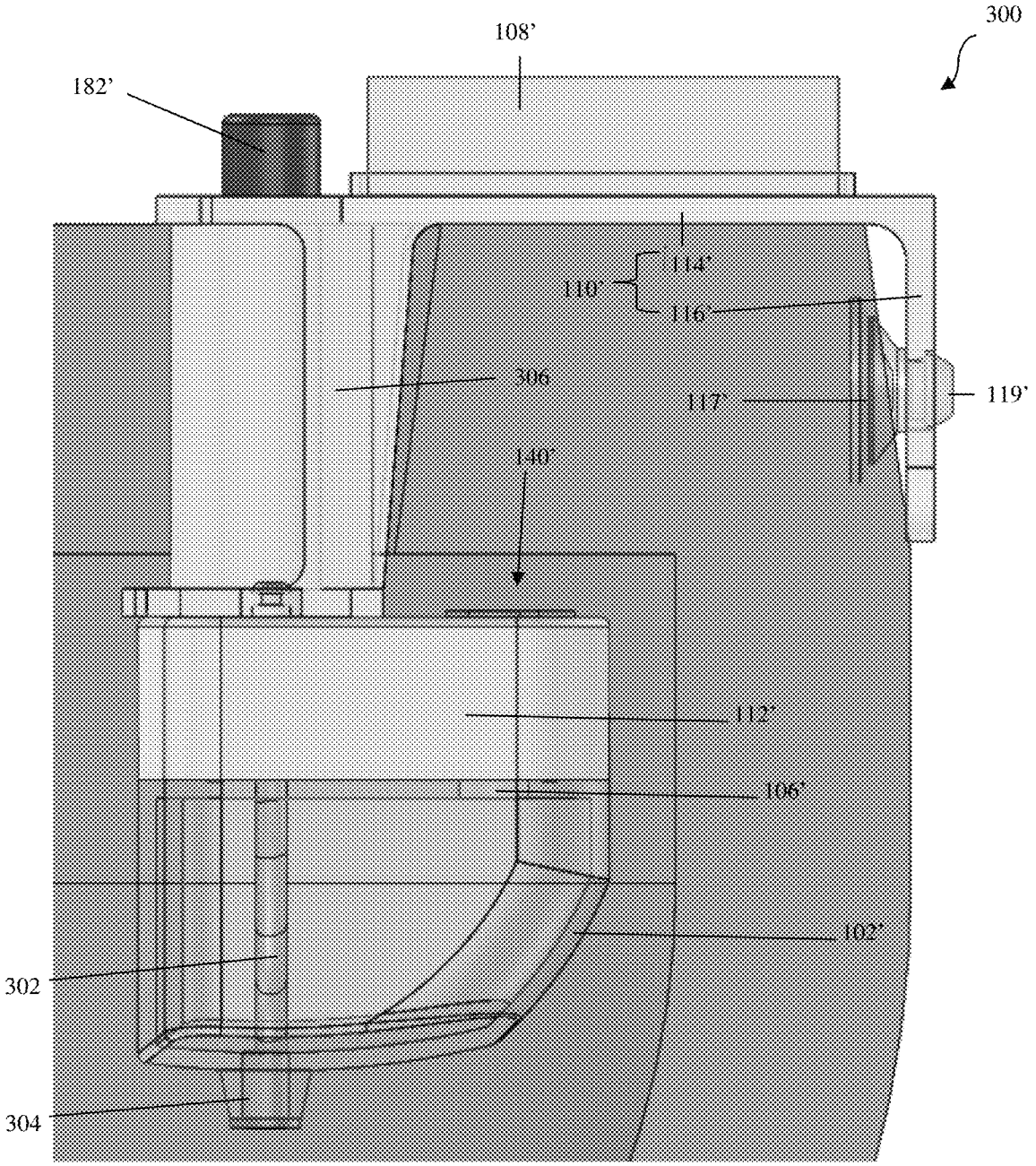
Figure 25:
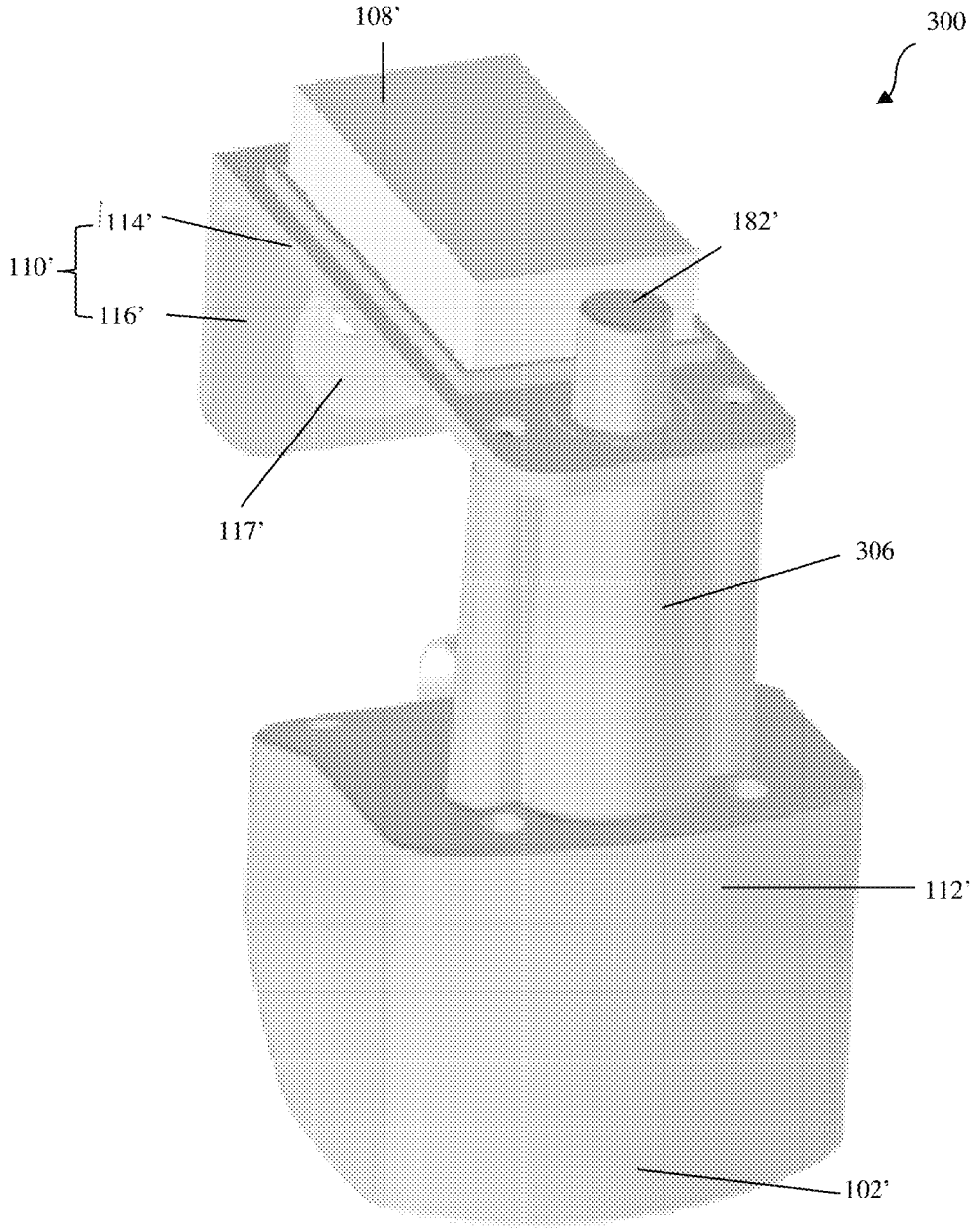
Figure 26:
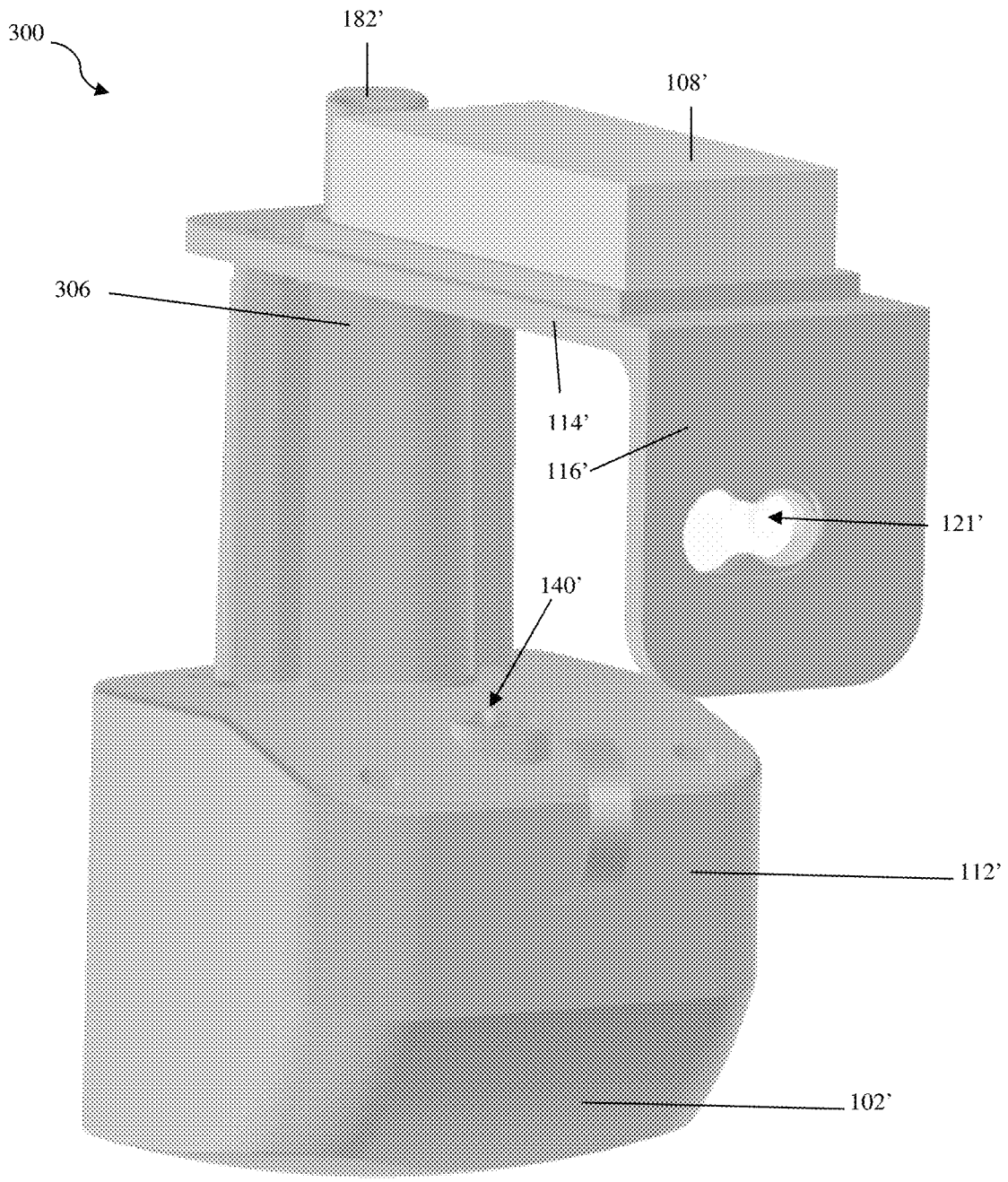

Turning to FIGS. 13 and 14, the pump 104 may operate by actuating the plunger handle 182 to move the plunger 164 and the piston 166 against the plunger spring 172 within the top and bottom cylinders 168, 170. The pump 104 may operate as a force piston pump such that the upstroke of the plunger 164 away from the bottom cylinder 170 may draw a liquid from the storage reservoir 102 into the bottom cylinder 170 through the intake pipe 194. A downward stroke of the plunger 164 towards the bottom cylinder may then dispel the liquid from the top and bottom cylinders 168, 170 out through the nozzle pipe 198 and the nozzle opening 200. In some instances, the up and downward stroke of the pump 104 may similarly displace and move some air in the storage reservoir 102 with the liquid. The pump 104 may operate as a positive-displacement pump such that approximately the same amount of liquid may be displaced (drawn in and dispelled) by each rotating cycle of the pumping element.

When a downward force is applied against the plunger handle 182, the plunger 164 and the piston 166 are moved within the top cylinder 168 toward the bottom cylinder 170 such that the plunger spring 172 is compressed and the volume between the piston 166 and the base 202 of the bottom cylinder 170 reduces. When the force against the plunger handle 182 is released, the built up elastic potential energy in the plunger spring 172 due to the compression and deformation in the spring 172 releases such that the plunger spring 172 pushes the piston 166 and the plunger 164 back to its initial position.

When the plunger spring 172 is compressed and the volume within the bottom cylinder 170 decreases, the pressure within the bottom cylinder 170 increases. The increase in pressure in the bottom cylinder 170 in turn translates into an increase in pressure and force being applied throughout the intake and nozzle pipes 194, 198. In the intake pipe 194, the increase in pressure in the bottom cylinder 170 applies a force and compresses the intake plug 180 against the bottle neck gap 210 thereby maintaining the intake valve 214 in the closed position and preventing any liquid or air from flowing into the intake pipe 194 from the intake tube. Since the intake plug 180 is unable to move due to compression against the bottle neck gap, the volume within the intake pipe 194 may also remain constant thereby allowing the pressure within the intake pipe 194 to increase along with the pressure in the bottom cylinder.

In the nozzle pipe 198, the increase in pressure in the bottom cylinder 170 and intake pipe 194 may apply a force through the outlet opening 226 against the nozzle plug 176. Once the force applied against the nozzle plug 176 built up from the increase in pressure in the bottom cylinder 170 and the intake pipe 194 exceeds the natural resistance of the nozzle spring 174 to being deformed, the pressure and force from the bottom cylinder 170 may compress the nozzle spring 174 as the nozzle plug 176 is pushed away from the blocking flange 224. As the space between the nozzle plug and blocking increases due to the nozzle spring being compressed, the nozzle valve 228 opens and liquid and air may flow from the bottom cylinder into the nozzle pipe 198 in order to relieve the built up pressure within the bottom cylinder and the intake pipe 194.

When the force on the plunger handle 182 is removed, the compressed plunger spring 172 will release the elastic potential energy stored within the plunger spring 172 to restore the original shape of the plunger spring 172. As the plunger spring 172 extends back to its original shape, the plunger spring 172 will push the piston 166 and the plunger 164 away from the bottom cylinder 170 thereby creating the upstroke element of the plunger and the piston within the pump 104. The upstroke of the plunger and piston may create a partial vacuum within the space between the piston and the bottom cylinder 170 thereby applying a suction force against the intake and nozzle plugs 180, 176. Once the force on the intake plug 180 applied by vacuum exceeds the natural resistance of the nozzle spring 174 from being deformed, the force from the vacuum may compress the intake spring 178 and pull the intake plug 180 away from the blocking member 212 thereby opening the intake valve 214 and allowing liquid and air to be drawn into the intake pipe 194 and bottom cylinder 170 from the intake tube. Due to contact between the nozzle plug 176 against the outlet opening at the blocking flange 224, the force from the vacuum will not move the nozzle plug, the nozzle valve 228 will remain closed, and no liquid or air will flow from the bottom cylinder 170 into the nozzle pipe 198.

Figure 5:
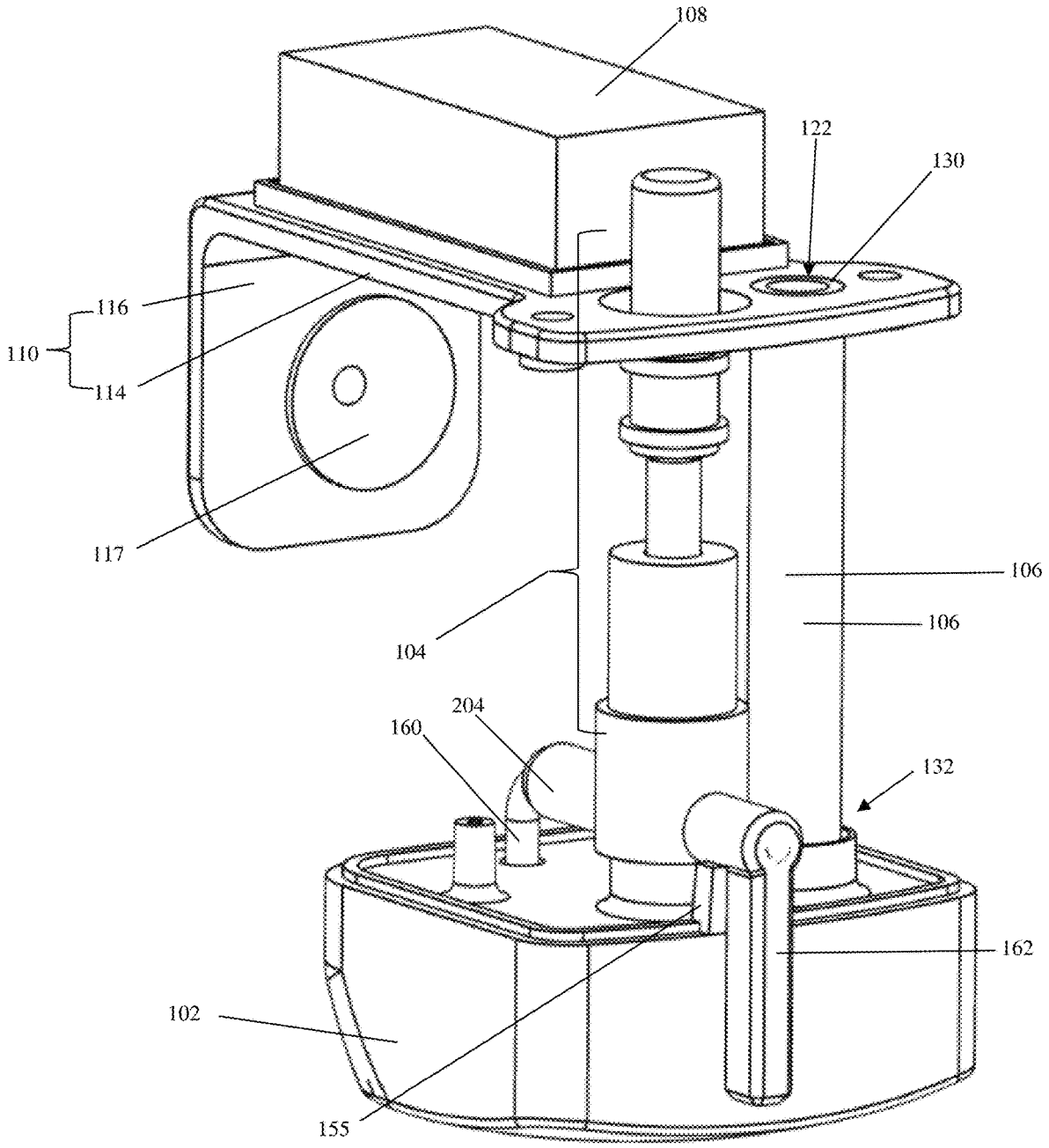

As shown in FIGS. 1-5, the dispenser 100 may be assembled by fitting the mount 11, housing cover 112, filling tube 106, and storage reservoir 102 together. As shown in FIG. 5, the filling tube 106 may initially be inserted into the first opening 150 in the storage reservoir 102 to connect the two parts. The pump 104 may then be assembled with the storage reservoir 102 by seating the base 202 of the pump 104 into the pump slot 154 and the nozzle pipe 198 on the nozzle cradle 154. The shape of the nozzle cradle 154 may be formed to be a complementary cut out of the shape of the lower portion of the nozzle pipe 198 to provide stability and support to the nozzle pipe 198 when seated in the nozzle cradle 154. The pump 104 and the storage reservoir 102 may then be connected using the intake tube 160 by inserting one end of the intake tube 160 into the second opening 152 in the storage reservoir 102 and the other end of the intake tube 160 into the intake sleeve 204 adjacent the intake pipe 194.

With the pump 104 and filling tube 106 secured on the storage reservoir 102, the storage reservoir 102 may then be affixed to the housing cover 112 and the mount 110 as shown in FIGS. 14-22. When the housing cover 112 and mount 110 are fitted over the storage reservoir 102, the filling tube 106 may extend from the storage reservoir 102 through the first openings 140, 132 in the housing cover 112 and the mount 110, respectively. The pump 104 may similarly extend from the storage reservoir 102 through the second openings 142, 124 in the housing cover 112 and the mount 110, respectively. The housing cover 112 may be formed with an arched nozzle cover 230 such that the nozzle cover 230 creates an opening for the nozzle 162 when the housing cover 112 is affixed over the storage reservoir 102. The arched nozzle cover 230 may be positioned such that when the housing cover 102 is fitted over the pump 104 and the storage reservoir 102, the nozzle 162 may extend outwards from the pump 104 into the space created by the arched nozzle cover 230. The second conduit 222 of nozzle 162 extending out of the nozzle cover 230 may then dispense the liquid agent inside the storage reservoir 204 downwards out of the opening created by the nozzle cover 230.

When the dispenser 100 is assembled, the top of the plunger handle 182 may extend through the second opening 124 in the mount 110 such that the plunger handle 182 may be actuated and manipulated by a user to actuate the pump 104. The first opening 122 in the mount 110 may allow for a liquid to be poured directly into the storage reservoir 102 without disassembling the dispenser 100. The dispenser 100 may operate to dispense the liquid agent stored in the storage reservoir 102 through nozzle 162 when the pump 104 is actuated by an exterior force.

In operation, the liquid agent to be dispensed into the toilet 400 by the dispenser 100 may be stored in the storage reservoir 102 by initially being poured into the filling tube 106 through the first opening 122 in the mount 110. When filling the storage reservoir 102, the liquid agent being deposited may flow through the one way filling valve 136, down the rest of the filling tube 106 and into the storage reservoir 102. After the storage reservoir 102 is filled but before the dispenser 100 can be used, the pump 104 must be primed to remove air from the pump 104 and any associated suction lines. During the primping the process, the liquid in the storage reservoir 102 will fill the pump and force out all the air, gas, or vapor contained in the pump 104. The pump 104 may be primed by successively actuating the pump 104 multiple times until the liquid agent in the storage reservoir 104 is dispelled from the nozzle 162.

Once the dispenser 100 is primed, the dispenser 100 may be actuated to dispense the liquid in the storage reservoir 102 every time the plunger handle 182 is pressed.

After the dispenser 100 is primed, before or after mounting on the toilet 400, the dispenser 100 may be ready for use. Preferably after its priming, the dispenser 100 may be fitted on the toilet 400 by engaging the mount 110 over the edge of the toilet 400. When the dispenser 100 is affixed to the toilet 400, the body of the dispenser 100 which may comprise the storage reservoir 102, the pump 104, the filling tube 106, and the housing cover 112 may be positioned inside the toilet bowl 402, the first member 114 of the mount 110 may be positioned across the top edge of the toilet bowl 402, and the second member 116 of mount 110 may be extending downwards along the exterior of the toilet bowl 402.

When the dispenser 100 is fitted on the toilet 400, the protruding plunger handle 182 and the cushion 108 may be positioned to be in direct contact with a toilet seat 408 when the toilet seat 408 is put down on top of the toilet 400 and dispenser 100. When dispenser 100 is mounted on toilet 400 and the toilet seat 408 is down, the toilet seat 408 may be held above the top edge 404 of the toilet bowl 402 by the thickness of the cushion 108 and the height of the portion of pump 104 extending out of the mount 110. The initial height the toilet seat 408 may be held at above the top edge 404 prior to being pressed down by a user may become at least the displacement distance of the plunger handle 182 when a user sits on the toilet seat 408. The cushion 108 and the plunger handle 182 may be positioned and formed such that the weight of the toilet seat 408 on the dispenser 100 alone would not cause the toilet seat 408 to actuate the pump 104.

The dispenser 100 may be positioned such that the dispenser 100 would be actuated every time a user of the toilet 400 applies a force down on the toilet seat 408 (such as by sitting on the toilet seat 408 to use the toilet). When a user sits on the toilet seat 408, the weight of the user may then push the toilet seat 408 down against the top edge 404 of the toilet 400 while simultaneously also depressing the toilet seat 408 down on both the cushion 108 and the plunger handle 182 of the pump 104. The weight of the user on the toilet seat 408 may depress the plunger handle 182 and actuate the dispenser 100 to dispense the liquid agent inside the storage reservoir 102 out the nozzle 162. Alternatively, the dispenser 100 may be actuated without sitting on the toilet seat 408 by manually or otherwise by depressing the toilet seat 408 in contact with the plunger handle 182 or the plunger handle 182 directly to actuate the pump 104.

When the user gets off the toilet seat 408, the removal of the user's weight from the toilet seat 408 and the plunger handle 182 may allow the plunger spring 172 to push the plunger 164 back to its original position. If the toilet seat 408 is not lifted off the toilet bowl 402 after the user gets off the toilet seat 408, the cushion 108 may also aid in returning the plunger 164 back to its original position in the pump 104 by applying an upward force against the toilet seat 408 and lifting the toilet seat 408 off the top of the plunger handle 182. The cushion 108 may aid by further decreasing any remaining downwards force applied on the plunger handle 182 due to the weight of the toilet seat 408 itself.

The dispenser 100 may operate such that the pushing of the plunger handle 182 down by the application of a force on the toilet seat 408 by the user actuates the downstroke element of the pump 104. The downward stroke of the pump 104 in turn increases the pressure in the bottom cylinder 170, opens the nozzle valve 174, and dispels a volume of the liquid through the nozzle pipe 198 and out the nozzle 162. The immediate and automatic actuation of the dispenser 100 by the application of a weight on the toilet seat 408 (usually an indication the user is about to use the toilet) releases agents that are designed to be applied before the toilet 400 is used. Once the weight of the user is removed from the toilet seat 408, the force against the plunger handle 182 may in turn also be removed and the plunger spring 172 may then actuate the upward element of the pump 104. The upward stroke of the pump 104 may then open the intake valve 214 and draw in additional liquid from the storage reservoir 102 into the bottom cylinder 170, effectively "resetting" the pump 104 in preparation for the next use of the dispenser 100.

Referring now to FIGS. 23-26, a dispenser 300 is shown as another embodiment of the invention. Dispenser 300 incorporates numerous component parts which are substantially identical in construction and operation to the component parts of dispenser 100 illustrated in FIGS. 1-22. Such identical parts and components are designated in FIGS. 23-26 with the same reference numerals utilized in the description of dispenser 100 but are differentiated therefore by means of a (') designation.

Dispenser 300 may differ from the embodiment of dispenser 100 shown in FIGS. 1-22 primarily with regards to the filling tube 106', the housing cover 112', the nozzle pipe 198', and the nozzle 162'. Dispenser 300 may also further comprise a nozzle tube 302, a nozzle head 304, and a pump casing 306.

In dispenser 300, instead of the pump 104' being encased by the housing cover 112' with a portion of the plunger handle 182' extending out of the mount 110' affixed to the housing cover 112' as in dispenser 100, the pump 104' comprising of the top cylinder 168' and the plunger 164' may instead be enclosed by the pump casing 306 affixed between the housing cover 112' and the mount 110'. The dispenser 300 may therefore be assembled with the bottom cylinder 170' seated on top of the storage reservoir 102 and enclosed by the housing cover 112' and the pump 104' connected to the bottom cylinder 170' and extending through the pump casing 306 to the mount 110'. The mount 110' may then be affixed over the top of the pump casing 306 with the plunger handle 182' extending through and out the mount 110 adjacent the cushion 108'.

In dispenser 300, the filling tube 106' may be positioned differently from the filling tube 106 in dispenser 100 such that the first opening 140' in housing cover 112' leading to the first end 130' of the filling tube 106' may be positioned near the rear of the dispenser 300 below the first member 114' of mount 110' and the cushion 108'.

The nozzle 162 affixed to the bottom cylinder 170' in dispenser 300 may be positioned completely within the housing cover 112' and may instead be connected to the nozzle tube 302. The nozzle tube 302 may then extend through the storage reservoir 102' to the nozzle head 304' formed at the bottom of the storage reservoir 102'. The liquid agent pumped by the pump 104' in dispenser 300 must therefore flow from the nozzle 162' through the nozzle pipe 302 before being dispensed through the nozzle head 304.

Having thus described the present invention by reference to certain of its exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of exemplary embodiments. Accordingly, it is appropriate that any claims supported by this description be construed broadly and in a manner consistent with the scope of the invention.

We claim:

1. An apparatus for dispensing a liquid into a toilet bowl, comprising:

a reservoir for holding a quantity of liquid;

a piston pump, comprising a pump inlet and a pump outlet, wherein the pump is configured to receive fluid from the reservoir through the pump inlet and expel liquid out the pump through the pump outlet;

a linear actuator operatively connected to the piston pump, wherein the linear actuator is configured to linearly actuate the piston pump when the linear actuator is depressed;

a mount configured to suspend the piston pump and the linear actuator together on a toilet bowl;

wherein the piston pump is in fluid communication with the reservoir for transferring liquid from the reservoir to the piston pump through the pump inlet;

wherein the piston pump is in fluid communication with an interior of the toilet bowl to dispense fluid expelled from the pump outlet into the toilet bowl;

wherein when the piston pump is linearly actuated by depressing the linear actuator, fluid from the reservoir is dispensed into the toilet bowl;

wherein the mount comprises a housing and a support member extending from the housing, wherein the housing is configured to support the pump, the linear actuator, and the reservoir together on a rim of a toilet bowl, and wherein the support member is configured to affix the housing to the toilet bowl to suspend the housing, the pump, the linear actuator, and the reservoir over an interior of the toilet bowl; and further comprising a filling tube extending between the housing and the reservoir, wherein the filling tube is configured to direct liquid into the reservoir through the filling tube from outside the housing when the reservoir is connected to the housing.

2. The apparatus in claim 1, wherein the filling tube further comprises a one-way valve configured to maintain a seal within the filling tube between the housing and the reservoir.

* * * * *